US008587627B2

(12) United States Patent
Takahashi et al.

(10) Patent No.: US 8,587,627 B2
(45) Date of Patent: Nov. 19, 2013

(54) IMAGE FORMING APPARATUS CONFIGURED TO CONTROL A LIGHT AMOUNT OF A LIGHT BEAM FOR FORMING A MISALIGNMENT DETECTION PATTERN

(75) Inventors: Katsumi Takahashi, Moriya (JP); Shinya Suzuki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 48 days.

(21) Appl. No.: 13/204,998

(22) Filed: Aug. 8, 2011

(65) Prior Publication Data

US 2012/0038731 A1 Feb. 16, 2012

(30) Foreign Application Priority Data

Aug. 16, 2010 (JP) ..... 2010-181856

(51) Int. Cl.
*B41J 2/435* (2006.01)
*B41J 2/47* (2006.01)

(52) U.S. Cl.
USPC ..... 347/234; 347/229; 347/248

(58) Field of Classification Search
USPC ..... 347/116, 229, 232, 234, 235, 248–250
See application file for complete search history.

(56) References Cited

U.S. PATENT DOCUMENTS

| | | | | |
|---|---|---|---|---|
| 6,631,249 | B2 | 10/2003 | Katsumi et al. | |
| 6,640,077 | B2 | 10/2003 | Suzuki et al. | |
| 6,853,392 | B2 | 2/2005 | Maeda | |
| 6,999,708 | B2 | 2/2006 | Maeda | |
| 7,206,531 | B2 | 4/2007 | Suzuki et al. | |
| 7,209,673 | B2 | 4/2007 | Suzuki et al. | |
| 7,415,231 | B2 | 8/2008 | Maeda | |
| 8,305,637 | B2 | 11/2012 | Shinohara | |
| 2004/0239747 | A1 | 12/2004 | Maeda | |
| 2007/0231020 | A1 * | 10/2007 | Kadowaki | 399/301 |
| 2009/0269089 | A1 * | 10/2009 | Nishikawa et al. | 399/39 |

FOREIGN PATENT DOCUMENTS

| | | | |
|---|---|---|---|
| CN | 101539741 | A | 9/2009 |
| JP | 05-328130 | A | 12/1993 |
| JP | 2000-098810 | A | 4/2000 |
| JP | 2004-126528 | A | 4/2004 |
| JP | 2004-287403 | A | 10/2004 |

OTHER PUBLICATIONS

Notification of the First Office Action dated Sep. 10, 2013, in Chinese Application No. 201110234366.1.

* cited by examiner

*Primary Examiner* — Hai C Pham
(74) *Attorney, Agent, or Firm* — Fitzpatrick, Cella, Harper & Scinto

(57) ABSTRACT

An image forming apparatus includes an image forming unit having an exposure unit configured to irradiate each of a plurality of photosensitive members with a corresponding light beam, a light amount control unit configured to control a light amount of the light beams, a plurality of developing units configured to develop electrostatic latent images formed on the photosensitive members by exposure with the light beams, and a transfer unit configured to transfer toner images formed on the photosensitive members onto an image carrier; a pattern forming unit configured to control the image forming unit to form a misalignment detection pattern for detecting a relative misalignment between the toner images transferred onto the image carrier; a pattern reading unit configured to read the misalignment detection pattern; and a correction unit configured to correct the relative misalignment between the toner images based on the reading result obtained by the pattern reading unit.

20 Claims, 16 Drawing Sheets

IMAGE FORMING APPARATUS CONFIGURED TO CONTROL A LIGHT AMOUNT OF A LIGHT BEAM FOR FORMING A MISALIGNMENT DETECTION PATTERN

BACKGROUND OF THE INVENTION

1. Field of the Invention

The present invention relates to an image forming apparatus and, more particularly, to a technique of correcting misregistrations between the respective colors in an electrophotographic color image forming apparatus.

2. Description of the Related Art

Conventionally, for example, a multicolor image forming apparatus has been proposed, which includes a plurality of image forming units and can form a color image in the following procedure. Each image forming unit applies a laser beam onto a drum-like electrophotographic photoreceptor as an image carrier, that is, a photosensitive drum. Each unit forms an electrostatic latent image on the photosensitive drum by an electrophotographic process. A developing device develops this electrostatic latent image and turns it into a visible image (toner image). Transfer units multi-layer-transfer the toner images, formed on the photosensitive drums by the respective image forming units, onto a transfer material conveyed by a belt-like transfer material conveyor (transfer convey belt), or perform multiple transfer of the respective images on a belt-like intermediate transfer member (intermediate transfer belt). Thereafter, the images are collectively transferred onto a transfer material.

In this type of image forming apparatus, misalignments occur between the respective color images formed on the respective photosensitive drums due to various factors. Registration for the cancellation of such misalignments may sometimes become incomplete on a transfer material on which images finally undergo multiple transfers. The various factors in this case include, for example, mechanical mounting errors between the respective photosensitive drums, optical path length errors between the respective laser beams, and optical path changes.

FIGS. 1, 2A, and 2B show a case of coping with a situation in which registration is incomplete. Conventional photosensitive drums 11, that is, 11*a*, 11*b*, 11*c*, and 11*d*, are used to form registration correction patterns 70 as misalignment detection patterns on an endless belt such as an intermediate transfer belt 31 (or transfer convey belt) as the second image carrier. Photosensors 60 and 61 as pattern detection units placed adjacent to the photosensitive drum 11*a* of the image forming unit on the most downstream side read the patterns and detect misregistrations the photosensitive drums 11 corresponding to the respective colors formed by the respective image forming units. This apparatus electrically corrects an image signal to be printed by using detected misalignment values.

Various patterns have been proposed as registration correction pattern images. For example, Japanese Patent Laid-Open No. 2000-98810 has proposed a pattern including the first line segment placed at a predetermined angle relative to a process direction as the moving direction of an endless belt and the second line segment placed symmetrically with the first line segment about a virtual line perpendicular to the process direction.

A pattern detection unit is constituted by a light-emitting element, such as an LED or phototransistor, and a light-receiving element, that is, a photosensor as a pattern reading unit. The pattern detection unit reads such a registration correction pattern image. Two such photosensors are arranged at a predetermined distance from each other in a direction perpendicular to the process direction. A registration correction pattern image is formed so as to pass over the photosensors.

FIG. 3 shows how the photosensors 60 and 61 detect the registration correction pattern 70 on the intermediate transfer belt 31. Note that the intermediate transfer belt 31 is made of a material whose reflectance of light (for example, infrared light) emitted by light-emitting elements (LEDs) in the photosensors 60 and 61 is higher than that of the registration correction pattern 70. Differences in reflectance of emitted light allow pattern detection.

FIG. 4 shows how a light-receiving element (phototransistor) PT receives reflected light emitted by the LED and reflected by the registration correction pattern 70 for image misalignment or the intermediate transfer belt 31. FIG. 5 shows a light-receiving circuit which converts the reflected light received by the phototransistor PT into electrical signal.

First of all, when the photosensors 60 and 61 detect reflected light from the intermediate transfer belt 31, since the reflected light amount is large, a large photocurrent flows in the phototransistor PT. A resistor R1 converts current into voltage. Resistors R2 to R4 and an operational amplifier OP1 amplify the voltage. When the photosensors 60 and 61 detect reflected light from the registration correction pattern 70 formed on the intermediate transfer belt 31, since the reflected light amount is small, a photocurrent smaller than that flowing upon detection of reflected light from the intermediate transfer belt 31 flows in the phototransistor PT. As in the above case, the resistor R1 converts the photocurrent into voltage, and the resistors R2 to R4 and the operational amplifier OP1 amplify the voltage.

The waveform pattern indicated by A in FIG. 4 shows how the light-receiving circuit detects reflected light from the intermediate transfer belt 31, the registration correction pattern 70, and the intermediate transfer belt 31 in the order named. As shown in FIG. 5, fixed resistors R5 and R6 set a threshold level at almost the midpoint between the detection level at the intermediate transfer belt 31 and the detection level at the registration correction pattern 70. A comparator OP2 then compares the value obtained by converting the current detected by the phototransistor PT into a voltage with the threshold level. This operation can generate a registration correction pattern detection output like the waveform pattern indicated by B in FIG. 4. The control unit of this system reads this pattern detection output which is sequentially transmitted, and detects a misregistration amount from pattern intervals and the like, thereby electrically correcting an image signal to be printed.

The registration correction described above is based on the premise that the registration correction pattern has a proper density. However, the density of the registration correction pattern varies due to environmental changes such as variations in temperature and humidity, deteriorations in toner materials over time, and the like. When, in particular, the density of the registration correction pattern decreases due to variations in temperature and humidity or the like or deteriorations in toner materials over time or the like, the registration correction accuracy also deteriorates.

If the density of the registration correction pattern for each color is not uniform, the rising or falling speed of an analog signal corresponding to the registration correction pattern changes. When the rising or falling speed of the analog signal changes, the timing of a leading or trailing edge of a pulse of a digital signal generated from the analog signal changes. More precisely, the change amount of the leading or trailing edge of a pulse of an analog signal varies for each color. For this reason, a color misalignment amount detected from pulses of digital signals includes the difference in change amount between the timings of edges. This leads to a deterioration in detection accuracy associated with the relative positional relationship between registration correction patterns.

The waveform pattern indicated by A in FIG. 4 has a bilaterally symmetrical pattern. However, an actual waveform pattern is not bilaterally symmetrical in a strict sense. This is because of the influences of the optical characteristics of each photosensor based on the installation positions of the LED and PT of the photosensor. An analog signal after a variation in the density of a registration correction pattern does not have a bilaterally symmetrical pattern, either. If, therefore, the density of a registration correction pattern excessively decreases, the change amounts of the gradients of the leading and trailing edges of an analog signal increase. This leads to deterioration in detection accuracy of the relative positional relationship between registration correction patterns.

In order to solve this problem, decreases in pattern image density are made to fall within the specifications of various types of image forming apparatuses by controlling changes (high voltage settings) of laser light amounts, charging biases to be set in chargers, and developing biases to be set in developing devices, and various kinds of process conditions for toner replenishment control in accordance with durability. Note however that as image density decreases, the density of a corresponding registration correction pattern decreases. That is, even if the image density can be made to fall within specifications, color misalignment may fall outside the specifications.

In order to prevent deterioration in registration correction accuracy, the laser light amount may be increased. If, however, the laser light amount is always increased in operation including printing operation, the charge of the latent image formed on the photosensitive drum may not be sufficiently removed. This may adversely influence the next printed image or cause early deterioration in the photosensitive drum.

SUMMARY OF THE INVENTION

According to one aspect of the present invention, there is provided an image forming apparatus comprising: an image forming unit including a plurality of photosensitive members, an exposure unit configured to irradiate each of the plurality of photosensitive members with a light beam, a light amount control unit configured to control a light amount of the light beam emitted from the exposure unit, a plurality of developing units configured to develop electrostatic latent images, formed on the plurality of photosensitive members by exposure with the light beams, by using different toners, and a transfer unit configured to transfer toner images formed on the plurality of photosensitive members onto an image carrier; a pattern forming unit configured to control the image forming unit to form, on the image carrier, a misalignment detection pattern for detecting a relative misalignment between the toner images transferred onto the image carrier; a pattern reading unit configured to read the misalignment detection pattern; and a correction unit configured to correct the relative misalignment between the toner images based on the reading result obtained by the pattern reading unit, wherein the exposure control unit controls, within predetermined set range, a first light amount as a light amount of the light beam emitted from the exposure unit to form the misalignment detection pattern and a second light amount as a light amount of the light beam emitted from the exposure unit to form an image based on image data input from an external apparatus or a reading apparatus; and the upper limit value in the predetermined set range for the first light amount of the light beam is set to be higher than the upper limit value in the predetermined set range for the second light amount.

According to another aspect of the present invention, there is provided an image forming apparatus comprising: an image forming unit including a plurality of photosensitive members, an exposure unit configured to irradiate each of the plurality of photosensitive members with a light beam, a light amount control unit configured to control a light amount of the light beam emitted from the exposure unit, a plurality of developing units configured to develop electrostatic latent images, formed on the plurality of photosensitive members by exposure with the light beams, by using different toners, and a transfer unit configured to transfer toner images formed on the plurality of photosensitive members onto an image carrier; a pattern forming unit configured to control the image forming unit to form, on the image carrier, a misalignment detection pattern for detecting a relative misalignment between the toner images transferred onto the image carrier; a pattern reading unit configured to read the misalignment detection pattern; and a correction unit configured to correct the relative misalignment between the toner images based on the reading result obtained by the pattern reading unit, wherein the exposure control unit is configured to control a maximum light amount of the light amount of the light beam for forming the misalignment detection pattern to be higher than a maximum light amount of the light amount of the light beam for forming an image based on image data input from an external apparatus or a reading apparatus.

According to another aspect of the present invention, there is provided an image forming apparatus comprising: an image forming unit including a plurality of photosensitive members, an exposure unit configured to irradiate each of the plurality of photosensitive members with a light beam, a light amount control unit configured to control a light amount of the light beam emitted from the exposure unit, a plurality of developing units configured to develop electrostatic latent images, formed on the plurality of photosensitive members by exposure with the light beams, by using different toners, and a transfer unit configured to transfer toner images formed on the plurality of photosensitive members onto a transfer material conveyed by a conveyor; a pattern forming unit configured to control the image forming unit to form, on the conveyor, a misalignment detection pattern for detecting a relative misalignment between the toner images transferred onto the transfer material; a pattern reading unit configured to read the misalignment detection pattern; and a correction unit configured to correct the relative misalignment between the toner images based on the reading result obtained by the pattern reading unit, wherein the exposure control unit controls, within predetermined set range respectively corresponding to the first light amount and the second light amount, a first light amount as a light amount of the light beam emitted from the exposure unit and a second light amount as a light amount of the light beam emitted from the exposure unit to form an image based on image data input from an external apparatus or a reading apparatus; and an upper limit value in the predetermined set range for the first light amount of the light beam is set to be higher than an upper limit value in the predetermined set range for the second light amount.

According to another aspect of the present invention, there is provided an image forming apparatus comprising: an image forming unit including a plurality of photosensitive members, an exposure unit configured to irradiate each of the plurality of photosensitive members with a light beam, a light amount control unit configured to control a light amount of the light beam emitted from the exposure unit, a plurality of developing units configured to develop electrostatic latent images, formed on the plurality of photosensitive members by exposure to the light beams, by using different toners, and a transfer unit configured to transfer toner images formed on the plurality of photosensitive members onto a transfer material conveyed by a conveyor; a pattern forming unit configured to control the image forming unit to form, on the conveyor, a misalignment detection pattern for detecting a relative misalignment between the toner images transferred onto the transfer material; a pattern reading unit configured to read the misalignment detection pattern; and a correction unit configured to correct the relative misalignment between the toner images based on the reading result obtained by the pattern reading unit, wherein the exposure control unit is configured to control the maximum amount of light of the light beam for forming the misalignment detection pattern to be higher than the maximum amount of light of the light beam for forming an image based on image data input from an external apparatus or a reading apparatus.

According to the present invention, it is possible to keep the density of a registration correction pattern proper regardless of environmental variations for an image forming apparatus, a deterioration in the durability of the apparatus, and the like and to always execute registration correction with high accuracy.

Further features of the present invention will become apparent from the following description of exemplary embodiments (with reference to the attached drawings).

DESCRIPTION OF THE EMBODIMENTS

First Embodiment

[Overall Arrangement]

Figure 1:
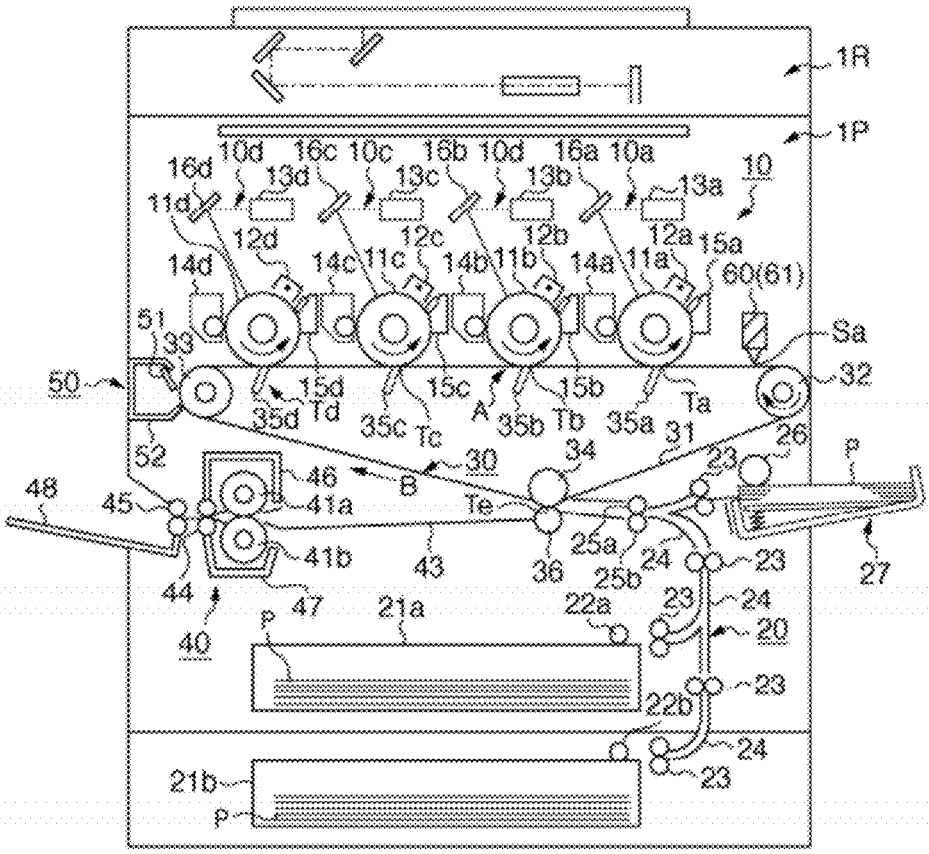
FIG. 1 is a schematic sectional view of an electrophotographic color copying machine.
Figure 2A:
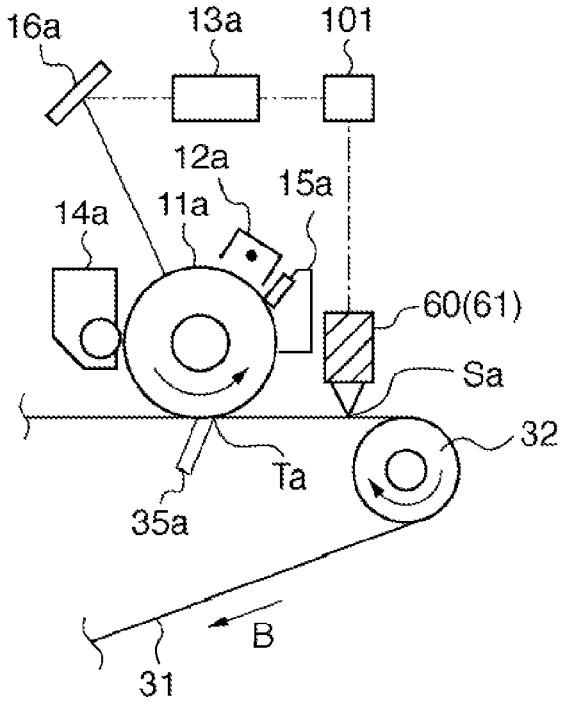
FIG. 2A PRIOR ART
FIGS. 2A and 2B are views showing a pattern reading unit and a registration correction pattern.
Figure 2B:
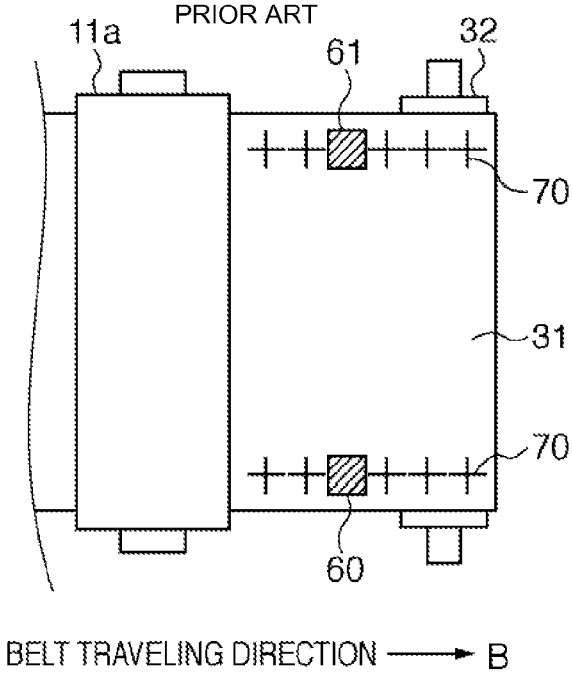
FIG. 2B PRIOR ART
Figure 3:
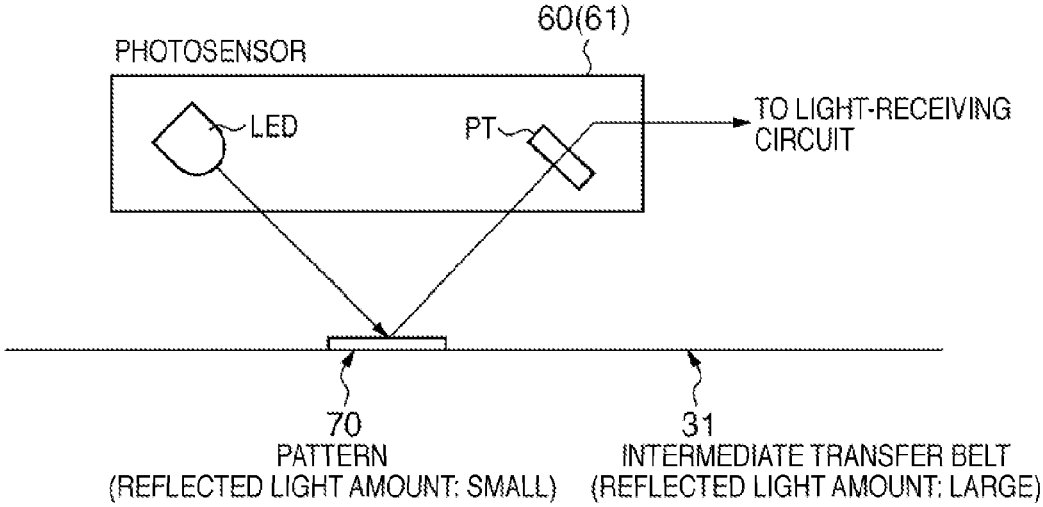
FIG. 3 PRIOR ART
FIG. 3 is a schematic view of a photosensor as a pattern reading unit.
Figure 4:
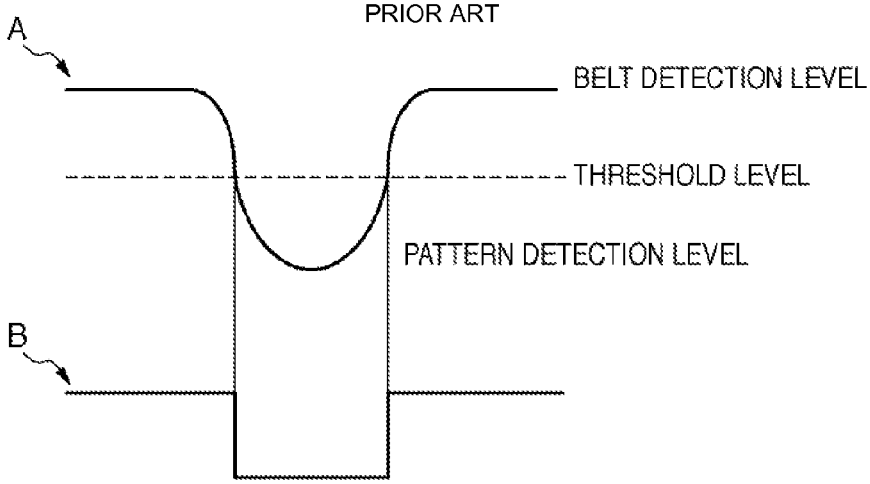
FIG. 4 PRIOR ART
FIG. 4 is a view showing detection of a registration correction pattern.
Figure 5:
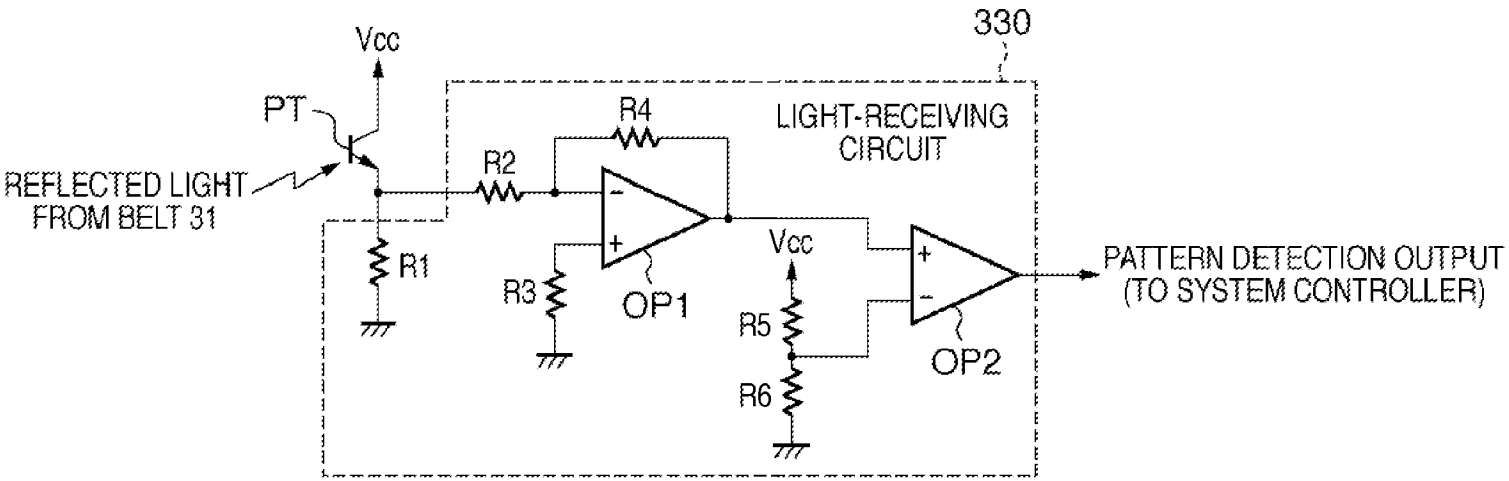
FIG. 5 PRIOR ART
FIG. 5 is a circuit diagram showing the arrangement of a light-receiving circuit which converts the light detected by a phototransistor into an electrical signal.

FIG. 1 is a schematic sectional view showing the overall arrangement of an electrophotographic color copying machine according to an embodiment of an image forming apparatus of the present invention. The electrophotographic color copying machine according to this embodiment is a color image output apparatus including a plurality of image forming units arranged side by side and using an intermediate transfer scheme, to which the present invention is expected to be applied effectively in particular.

In this embodiment, the electrophotographic color copying machine includes an image reading unit 1R and an image output unit 1P. The image reading unit 1R optically reads a document image, converts it into an electrical signal, and transmits it to the image output unit 1P. The image output unit 1P includes four image forming units 10, that is, 10*a*, 10*b*, 10*c*, and 10*d*, arranged side by side, a paper feed unit 20, an intermediate transfer unit 30, a fixing unit 40, and a cleaning unit 50.

Each unit will be described in more detail below. The image forming units 10*a*, 10*b*, 10*c*, and 10*d* have the same arrangement. In the image forming units 10*a*, 10*b*, 10*c*, and 10*d*, drum-like electrophotographic photoreceptors as the first image carriers, that is, photosensitive drums 11, that is, 11*a*, 11*b*, 11*c*, and 11*d*, are axially supported so as to be rotatable, and are driven to rotate in the direction indicated by the arrow. Primary chargers 12, that is, 12*a*, 12*b*, 12*c*, and 12*d*, optical systems 13, that is, 13*a*, 13*b*, 13*c*, and 13*d*, folding mirrors 16, that is, 16*a*, 16*b*, 16*c*, and 16*d*, developing devices 14, that is, 14*a*, 14*b*, 14*c*, and 14*d*, as developing units and cleaning devices 15, that is, 15*a*, 15*b*, 15*c*, and 15*d*, are arranged in the rotating directions of the photosensitive drums 11*a* to 11*d* so as to face their outer surfaces. The photosensitive drums 11*d* and 11*a* are respectively located on the upstream and downstream sides in the rotating direction of the belt.

The primary chargers 12*a* to 12*d* apply uniform amounts of charge to the surfaces of the photosensitive drums 11*a* to 11*d*. The optical systems 13*a* to 13*d* expose the photosensitive drums 11*a* to 11*d* to light beams such as laser beams modulated in accordance with print image signals from the image reading unit 1R through the folding mirrors 16*a* to 16*d*, thereby forming electrostatic latent images.

The developing devices 14*a* to 14*d*, which respectively store developing agents (to be referred to as "toners" hereinafter) of four colors, that is, yellow (Y), cyan (C), magenta (M), and black (Bk), then develop the electrostatic latent images turning them into visible images. The visible images developed on the first image carrier are transferred onto a belt-like intermediate transfer member as the second image carrier, that is, an intermediate transfer belt 31, which forms the intermediate transfer unit 30, at image transfer regions Ta, Tb, Tc, and Td. A registration correction pattern as a misalignment detection pattern (to be described below) is formed in the same manner as described above. The intermediate transfer unit 30 will be described in detail later.

On the downstream sides of the image transfer regions Ta, Tb, Tc, and Td, the cleaning devices 15*a*, 15*b*, 15*c*, and 15*d* clean the surfaces of the photosensitive drums 11*a* to 11*d* by scraping off the toners left on the respective drums without being transferred onto the intermediate transfer member. In the above process, images are sequentially formed by using the respective toners. As a result, the toners corresponding to the photosensitive drums 11 are superimposed and transferred onto the intermediate transfer unit 30.

The paper feed unit 20 includes cassettes 21*a* and 21*b* for storing transfer materials P, a manual feed tray 27, and pickup rollers 22*a*, 22*b*, and 26 for feeding the transfer materials P one by one from the cassette 21*a* or 21*b* or the manual feed tray 27. The paper feed unit 20 further includes a feed roller pair 23 for further conveying the transfer material P fed from the pickup roller 22*a*, 22*b*, or 26, a paper feed guide 24, and registration rollers 25*a* and 25*b* for feeding the transfer material P to a secondary transfer region Te in accordance with the image formation timing of each image forming unit.

The intermediate transfer unit 30 will be described in detail. The intermediate transfer belt 31 is stretched and wound around a driving roller 32 which transfers drive to the intermediate transfer belt 31, a driven roller 33 which follows the pivoting movement of the intermediate transfer belt 31 as a tension roller which applies proper tension to the intermediate transfer belt 31 with the biasing force of a spring (not shown), and a secondary transfer opposing roller 34. A primary transfer plane A is formed between the driving roller 32 and the driven roller 33. The intermediate transfer belt 31 is formed by using, for example, PET (polyethylene terephthalate), PVdF (polyvinylidene fluoride), or the like. The driving roller 32 is formed by coating the surface of a metal roller with a rubber (urethane or chloroprene) film having a thickness of several mm so as to prevent slippage with the belt. A pulse motor (not shown) drives to rotate the driving roller 32.

Primary transfer chargers 35, that is, 35*a* to 35*d*, are arranged, on the lower surface of the intermediate transfer belt 31, in the primary image transfer regions Ta to Td where the photosensitive drums 11*a* to 11*d* face the intermediate transfer belt 31. A secondary transfer roller 36 is placed to face the secondary transfer opposing roller 34, and forms the secondary transfer region Te by using the nip with the intermediate transfer belt 31. The semiconductor layer 36 is pressed against the intermediate transfer belt 31 with a proper pressure.

The cleaning unit 50 for cleaning the image formation surface of the intermediate transfer belt 31 is placed on the downstream side of the secondary transfer region Te of the intermediate transfer belt 31. The cleaning unit 50 includes a cleaning blade 51 for removing toners on the intermediate transfer belt 31 and a recovery toner box 52 storing recovered toners.

The fixing unit 40 includes a fixing roller 41*a* incorporating a heat source such as a halogen heater and a fixing roller 41*b* (which may include a heat source) which is pressed against the fixing roller 41*a*. The fixing unit 40 further includes a convey guide 43 for guiding the transfer material P to the nip portion between the pair of rollers 41*a* and 41*b* and fixing insulation covers 46 and 47 for confining heat in the fixing unit. The fixing unit 40 also includes an inner delivery roller 44 and outer delivery roller 45, which are used to guide the transfer material P delivered from the rollers 41*a* and 41*b* out of the apparatus, and a delivery tray 48 on which the transfer materials P are stacked.

In this embodiment, the image reading unit 1R reads an image to be output. However, the present invention is not limited to this. For example, the embodiment may be configured to acquire image data from an external apparatus connected via a storage medium or a network and output the acquired data.

[System Operation]

The operation of the electrophotographic color copying machine having the above arrangement will be described next. A system controller 101 controls the overall operation of the image forming apparatus, which will be described in detail later with reference to FIG. 6. When the system controller 101 generates an image forming operation start signal, the system starts feeding a sheet from a paper feed cassette based on a selected paper size or the like.

The following will exemplify a case in which a sheet is fed from the upper paper feed cassette. Referring to FIG. 1, first of all, the pickup roller 22*a* feeds the transfer materials P one by one from the cassette 21*a*. The feed roller pair 23 then guides the transfer material P along the paper feed guide 24 to the registration rollers 25*a* and 25*b*. At this time, the registration rollers 25*a* and 25*b* are stopped, and the leading end of the transfer material P comes into contact with the nip portion between the registration rollers 25*a* and 25*b*. Thereafter, the registration rollers 25*a* and 25*b* start rotating in accordance with the timing when the image forming unit starts forming an image. The timing of this rotation period is set to make the transfer material P coincide with the toner image primarily transferred onto the intermediate transfer belt 31 by the image forming unit in the secondary transfer region Te.

In the image forming unit 10, when the image forming operation start signal is generated, the toner image formed on the photosensitive drum 11*d* on the upmost stream side in the rotating direction of the intermediate transfer belt 31 in the above process is primarily transferred onto the intermediate transfer belt 31. At this time, the primary transfer charger 35*d* primarily transfers the toner image in the primary transfer region Td upon application of a high voltage. The primarily transferred toner image is conveyed to the next primary transfer region Tc. In this region, image formation is performed with a delay corresponding to the time taken to convey the toner image between the respective image forming units. The next toner image is transferred in accordance with registration while being registered on the preceding image. Subsequently, similar steps are repeated to primarily transfer the toner images of the four colors onto the intermediate transfer belt 31.

The transfer material P then enters the secondary transfer region Te and comes into contact with the intermediate transfer belt 31. At this time, a high voltage is applied to the semiconductor layer 36 in accordance with the passing timing of the transfer material P. With this operation, the above process transfers the toner images of the four colors formed on the intermediate transfer belt 31 onto the surface of the transfer material P. Thereafter, the convey guide 43 accurately guides the transfer material P to the fixing roller nip portion. The toner images are fixed on the transfer material P by the heat of the pair of rollers 41*a* and 41*b* and the pressure of the nip. Thereafter, the transfer material P is conveyed by the inner delivery roller 44 and the outer delivery roller 45, delivered outside the apparatus, and stacked on the delivery tray 48.

Figure 13:
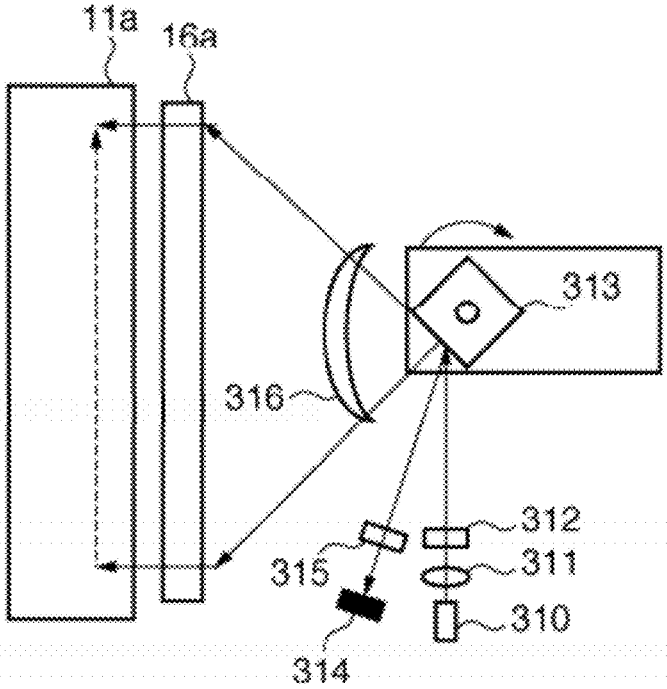
FIG. 13 is a view schematically showing a laser unit.

The laser unit which forms the image forming unit 10 will be described in more detail below with reference to FIG. 13. A laser emitting unit 310 outputs a light beam for forming a latent image on the photosensitive drum 11. The light beam passes through a collimator lens 311 to be collimated. A cylindrical lens 312 forms the collimated light beam into an image on a polygon mirror 313. The polygon mirror 313 is an example of a rotary polyhedral mirror, which is a rotating deflection element for deflecting and scanning an incident light beam. This implements a deflection unit. The polygon mirror 313 is integrally formed with a driving motor 321. Driving the driving motor 321 will rotate the polygon mirror 313 in the clockwise direction indicated by the arrow in FIG. 13.

The light beam reflected by the polygon mirror 313 propagates to the photosensitive drum 11*a* for image formation, and also propagates to a beam detect sensor (to be referred to as a BD sensor hereinafter) 314 as a light-receiving element which generates a scan synchronization signal for controlling a write timing in main scanning. The BD sensor 314 implements a synchronization signal output unit. An anamorphic lens 315 is a lens for forming reflected light from the polygon mirror 313 into an image on the BD sensor 314. An fθ lens 316 is a lens for adjusting a scanning velocity to a constant velocity at the peripheral and central portions of the lens. The folding mirror 16*a* deflects a light beam passing through the fθ lens 316 to scan it on the photosensitive drum 11*a*.

Figure 6:
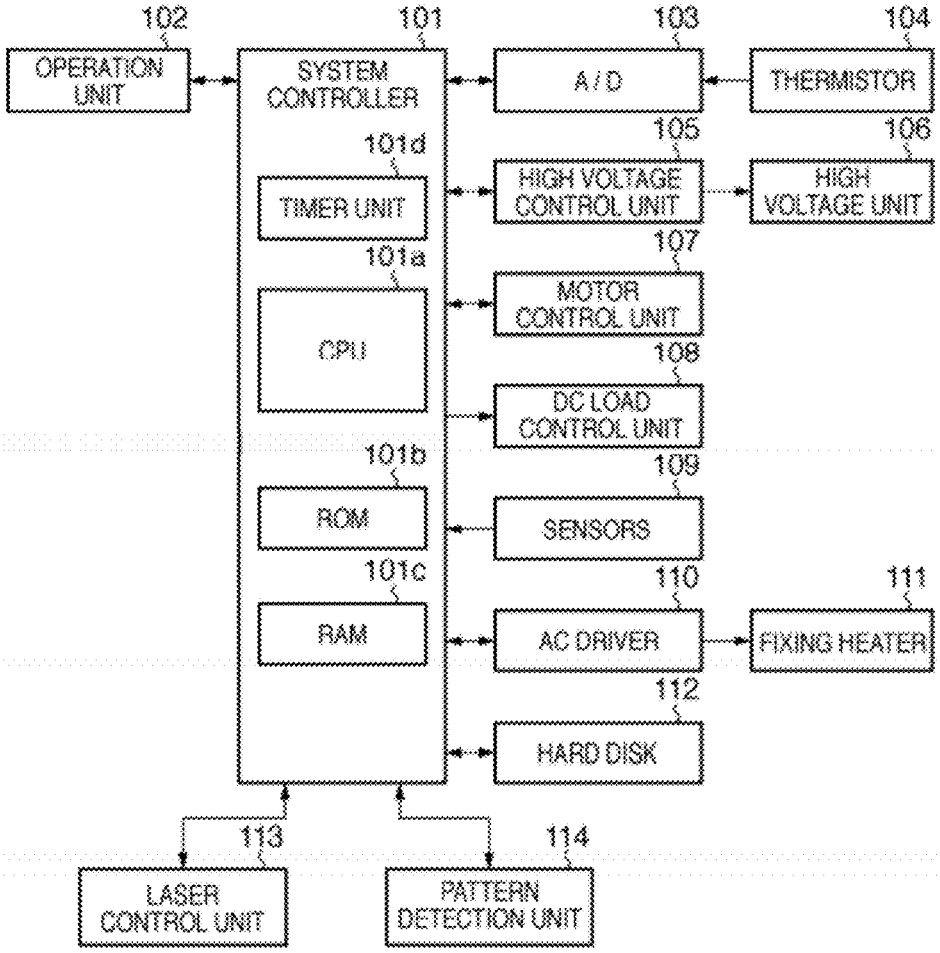
FIG. 6 is a schematic view showing the arrangement of the control system of an image forming apparatus.

An example of the arrangement of the control system of the apparatus according to the present invention will be described next with reference to FIG. 6. A CPU (Central Processing Unit) 101*a* of the system controller 101 comprehensively controls the overall apparatus. The CPU 101*a* is mainly in charge of driving each load in this apparatus, acquiring and analyzing information from sensors and the like, and exchanging data with an operation unit 102, that is, a user interface. To execute the above functions, the system controller 101 includes a ROM (Read Only Memory) 101*b*, a RAM (Random Access Memory) 101*c*, and a timer unit 101*d* connected to the CPU 101*a*.

The ROM 101*b* stores programs which can be executed by the CPU 101*a* to allow execute various sequences associated with predetermined image formation sequences. The RAM 101*c* stores rewritable data which need to be temporarily or permanently stored. The CPU 101*a* can use these data while executing a program. Note that the RAM 101*c* stores, for example, high voltage set values in a high voltage control unit 105 to be described later, various data to be described later, image formation command information from the operation unit 102, and the like. The timer unit 101*d* includes a plurality of timers for, for example, measuring the intervals between registration correction patterns (to be described later) and counting an image write timing.

This apparatus includes motors, DC loads such as clutches and solenoids, and sensors such as photointerrupters and micro power switches which are arranged at the respective positions in the apparatus. That is, the apparatus conveys a transfer material and drives the respective units by properly driving the motors and the respective DC loads, and various sensors monitor the operations of the respective units.

The system controller 101 causes a motor control unit 107 to control the respective motors, and at the same time, causes a DC load control unit 108 to operate the clutches and solenoids, based on signals from various kinds of sensors 109, thereby smoothly performing image forming operation. The high voltage control unit 105 transmits various kinds of high voltage control signals to apply proper high voltages to the respective types of chargers constituting a high voltage unit 106. Each fixing unit incorporates a heater 111 for heating the corresponding roller. An AC driver 110 ON/OFF controls the heater. In this case, each fixing roller is provided with a thermistor 104 for measuring the temperature of the roller. An A/D 103 converts a change in the resistance of the thermistor 104 with a change in the temperature of the corresponding fixing roller into a voltage value. This value is input as a digital value to the system controller 101. The AC driver 110 described above is controlled based on this temperature data.

A hard disk 112 is connected to the system controller 101. The hard disk 112 can store the image data transmitted from the image reading unit 1R. Data stored in the hard disk 112 is read out to be printed by operation from the operation unit 102.

The operation unit 102 accepts information such as the copying magnification and density set value which are set by the user, and presents the user with the state of the image forming apparatus, for example, information indicating the number of sheets on which images are to be formed and indicating whether image forming is being performed, the occurrence of a jam, its position, and the like.

Figure 7A:
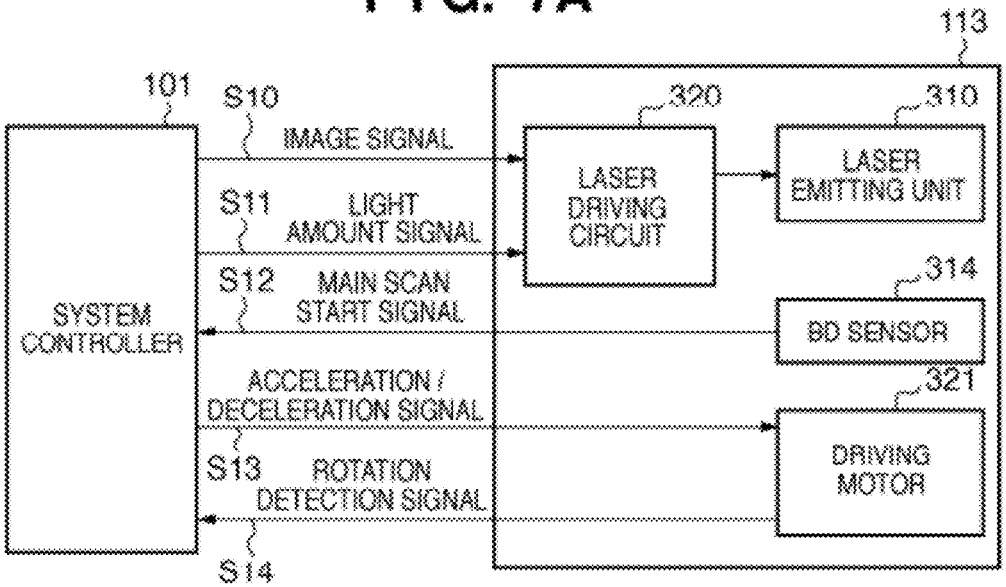
FIGS. 7A and 7B are schematic views showing the arrangements of a laser control unit and pattern detection unit.

The system controller 101 is connected to a laser control unit 113 associated with image write operation using laser beams and a pattern detection unit 114 associated with the detection of a registration correction pattern. The laser control unit 113 and the pattern detection unit 114 will be described in detail below with reference to FIGS. 7A and 7B. FIG. 7A is a schematic view showing control operation by the system controller 101 and the laser control unit 113. The system controller 101 controls the driving motor 321 to a target number of rotations by changing an acceleration/deceleration signal S13 based on a detection signal S14 whose frequency changes in synchronism with the rotation of the driving motor 321.

Upon controlling the rotational speed of the driving motor 321 within the range of rotational speeds corresponding to preset numbers of rotations, the system controller 101 turns on the laser and receives a main scan start signal S12 from the BD sensor 314. The system controller 101 then transmits an image signal S10 generated based on the data transmitted from the image reading unit 1R to a laser driving circuit 320 in synchronism with the timing of the main scan start signal S12. The system controller 101 also transmits a light amount signal S11 for setting a laser light amount to the laser driving circuit 320. The laser driving circuit 320 turns on the laser emitting unit 310 with the light amount set based on the light amount signal S11 in synchronism with the image signal S10.

Figure 7B:
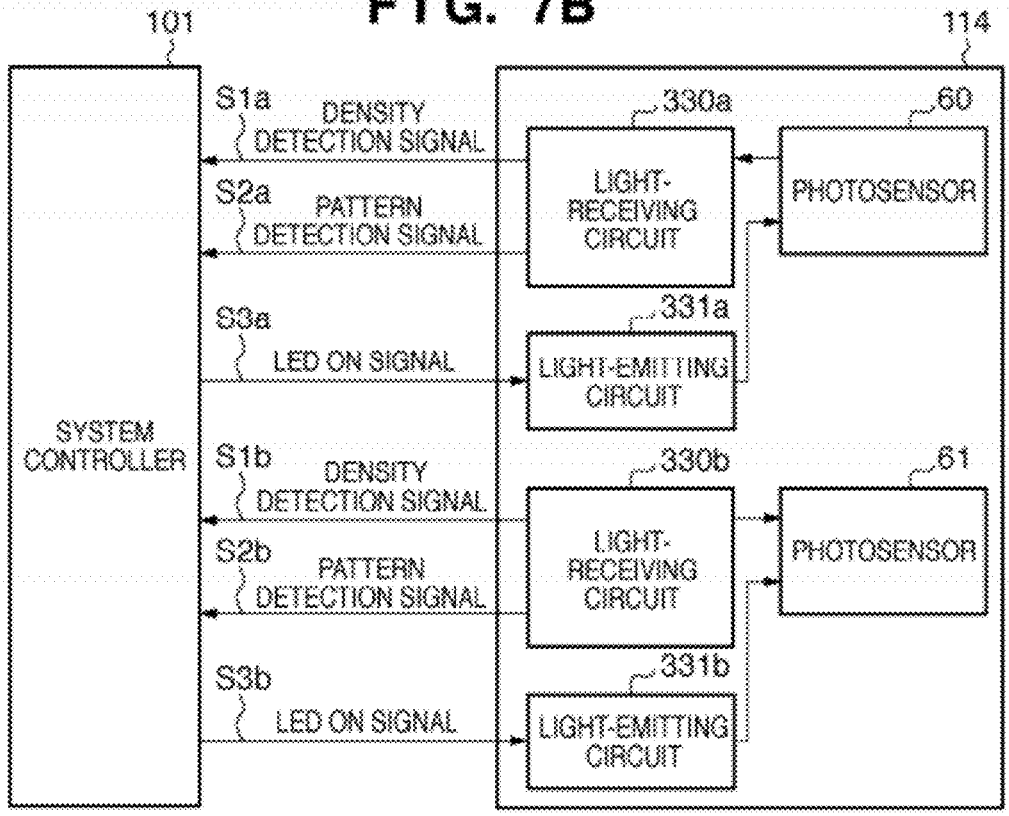

FIG. 7B is a schematic view showing control operation in the system controller 101 and pattern detection unit 114. Since photosensors 60 and 61 are provided at two positions, that is, the front and rear sides of the image forming apparatus in the main scanning direction, two signal systems are provided to control the photosensors 60 and 61. In density detection, this embodiment uses the photosensor 60 to detect the density patterns of yellow and magenta images, and the photosensor 61 to detect the density patterns of cyan and black images. In order to detect the gradient of a main scanning line, the embodiment uses both the photosensors 60 and 61 to detect a registration correction pattern for each color.

Since the respective control signals, that is, density detection signals S1*a* and S1*b*, pattern detection signals S2*a* and S2*b*, and LED ON signals S3*a* and S3*b*, respectively have similar functions, only the photosensor 60 will be described below. The system controller 101 transmits the LED ON signal S3*a* to a light-emitting circuit 331*a* at the time of density adjustment and registration correction. The light-emitting circuit 331*a* turns on the photosensor 60 based on the LED ON signal S3*a*.

The photosensor 60 transmits, to a light-receiving circuit 330*a*, an optical signal obtained by reading a density adjustment pattern or a registration correction pattern. The light-receiving circuit 330*a* then generates two signals to be transmitted to the system controller 101. One of these signals is a density detection signal S1*a* as an analog signal which changes in accordance with the density of the read pattern. The density detection signal is used for density correction. The other signal is a pattern detection signal S2*a* which is a High or Low digital signal output as a result of the comparison between a threshold held in advance in the light-receiving circuit 330*a* and an input optical signal. The pattern detection signal is used for registration correction control.

[Registration Correction]

Registration correction will be described next. The photosensors 60 and 61 as pattern reading units are positioned between the driving roller 32 and the photosensitive drum 11*a*, of the plurality of photosensitive drums, which is located most downstream in the belt traveling direction. The photosensors 60 and 61 read the registration correction patterns 70 formed on the intermediate transfer belt 31. The registration correction patterns 70 are position detection patterns formed on the intermediate transfer belt 31 to detect the relative misalignment amounts of toner images of the respective colors transferred onto the intermediate transfer belt 31. The image forming apparatus forms the registration correction pattern 70 for each color. The system controller 101 calculates the misalignment amount of a non-reference color image relative to a reference color image, based on outputs from the photosensors 60 and 61, and corrects the image formation position to reduce the misalignment. That is, if a black toner image is a reference color image, the system controller 101 calculates the misalignment amounts of registration correction patterns of other colors relative to the registration correction pattern of black based on outputs from the photosensors 60 and 61. The system controller 101 controls the image forming unit 10 to reduce the calculated misalignment amounts.

The above description has exemplified the case in which electrostatic latent images are transferred onto the intermediate transfer belt 31. However, this apparatus may be configured to form registration correction patterns on a transfer convey belt (conveyor) as a conveyor for transfer materials. Alternatively, the apparatus may be configured to form registration correction patterns on a transfer material. In this case, the photosensors 60 and 61 read the registration correction patterns formed on the transfer convey belt.

Figure 8:
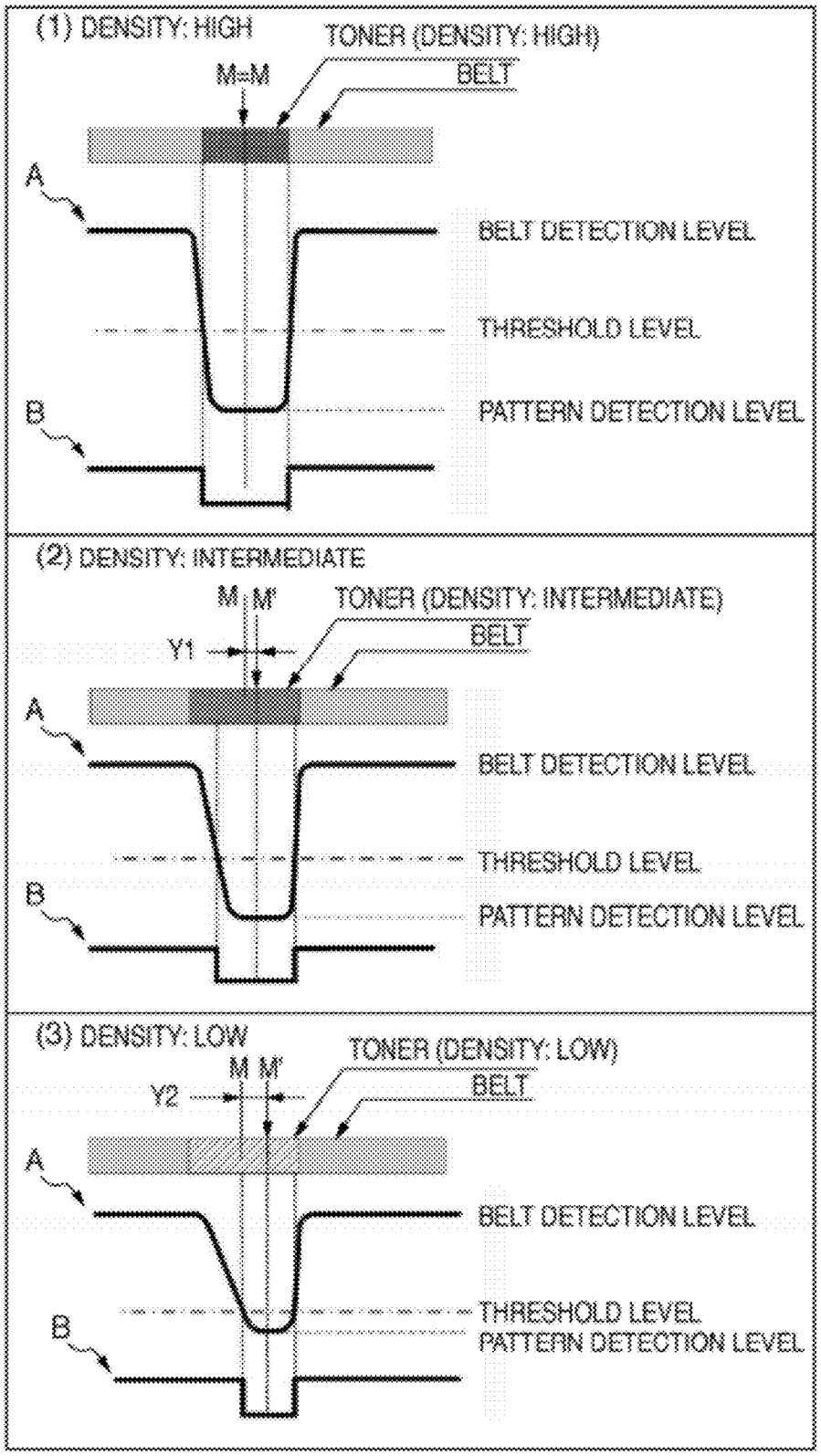
FIG. 8 is a view showing the read waveforms of registration correction patterns.

FIG. 8 shows the relationship between registration correction patterns and the waveforms read by the photosensors 60 and 61. Referring to FIG. 8, (1) indicates a case in which the toner density is high, (2) indicates a case in which the toner density is intermediate, and (3) indicates a case in which the toner density is low. As specific values, the densities in cases (1), (2), and (3) in this embodiment are defined as 1.4, 1.2, and 1.0, respectively.

In each of (1) to (3) in FIG. 8, A indicates how a light-receiving circuit 330 detects reflected light, and B indicates the registration correction pattern detection output generated by the light-receiving circuit 330. In this case, the intermediate transfer belt 31 is made of a material whose reflectance for light (for example, infrared light) emitted by the light-emitting elements (LEDs) in the photosensors 60 and 61 is higher than that of toner. For this reason, as indicated by A in each of (1) to (3) in FIG. 8, when the photosensors 60 and 61 each face the registration correction pattern 70 formed by toner, the corresponding output decreases in level. This makes it possible to obtain the position of the pattern.

First of all, the light-receiving circuit 330 converts the photocurrent generated by each of the photosensors 60 and 61 into a voltage. This voltage is compared with a predetermined threshold to be generated as a registration correction pattern detection output B. The registration correction pattern detection output B is input to the system controller 101. The timer unit 101*d* in the system controller 101 obtains the midpoint of the period during which a signal of each color is at LOW. The system controller then obtains the registration correction amounts of the respective colors relative to a reference color (Y in this embodiment) based on the position information of each midpoint.

The system controller changes write positions in main scanning and sub-scanning by changing the emission timing of laser light emitted from the laser emitting unit 310 described above. The system controller performs correction in the main scanning direction by changing the write timing on one line to be scanned on the photosensitive drum 11*a*. The system controller changes the emission timing of laser light to change the scan timing of the laser light, on the photosensitive drum 11*a*, reflected by the polygon mirror 313. At this time, since the system controller changes the scan timing of reflected laser light relative to the BD sensor 314, the main scan start signal generated by the BD sensor 314 changes in output level. As a result, this signal synchronizes with the changed scan synchronization signal to change the timing of image formation which has shifted in the main scanning direction. For example, delaying the write timing on a photosensitive drum by delaying the emission timing of laser light can shift the write position forward in the main scanning direction.

The system controller performs correction in the sub-scanning direction by changing the reflecting surface of the polygon mirror 313 by which laser light is reflected. For example, changing a given reflecting surface of the polygon mirror 313, which is rotating, to the next polygon mirror surface by delaying the emission timing of laser light can shift one line to the rear end side in the sub-scanning direction. Properly changing the emission timing of laser light can obtain a multiple image without any color misalignment.

[Problems to be Considered in Present Invention]

The registration correction described above can be accurately executed without being affected by response variations under a condition in which sensor outputs are ideal. The condition in which a sensor output is ideal indicates a condition in which the delay time of a signal change at the boundary point between the intermediate transfer belt 31 and the registration correction pattern 70 is 0 or the rising and falling times of a sensor output are equal in delay time. In contrast to this, the actual response time of the photosensor delays, and the rising and falling times differ in delay time. The factors for this include the difference in response speed between the rising time and the falling time which is intrinsic to the photosensor and the relationship between the location of the photosensor and the optical characteristics. In this case, the falling time indicates a time point when a transition occurs from a belt portion to a pattern portion in pattern detection, whereas the rising time indicated a time point when a transition occurs from a pattern portion to a belt portion in pattern detection.

The problems will be described with reference to FIG. 8. Referring to FIG. 8, reference symbol M denotes a midpoint of the detected toner density; M', a midpoint of the pattern as the detection result of the toner density; and Y1 and Y2, shifts from the respective midpoints. In this case, as indicated by (1) in FIG. 8, the photosensor 60 is placed so as to set the light emission/reception optical axis at a perfectly right angle with respect to the intermediate transfer belt 31. Under this condition, the sensor output level becomes highest when the registration correction pattern 70 exists at a position immediately below the photosensor 60, and gradually decreases as the registration correction pattern 70 moves away from the position immediately below the sensor. In this case, since the sensor output level reaches the peak at the position immediately below the photosensor 60 and gradually decreases with an increase in the distance between the photosensor 60 and the registration correction pattern 70. For this reason, the rising speed is almost equal to the falling speed, as indicated by A in (1) in FIG. 8.

In practice, however, it is difficult to set the optical axis at a perfectly right angle with respect to the belt, because of variations in the directivity characteristics of sensor components and variations in assembly. That is, the optical axis has a certain gradient as indicated by A in (2) in FIG. 8. The peak of a sensor output shifts from the position immediately below the sensor due to the influence of the gradient of the optical axis. This leads to a difference between the rising speed and the falling speed as indicated by A in (2) in FIG. 8. That is, the gradient of the rising speed is more moderate than that of the falling speed in the case shown in A in (2) in FIG. 8. In addition, this requires a certain time to output a value exceeding a threshold level for the recognition of toner. Therefore, an output value includes an error.

As indicated by (1) to (3) in FIG. 8, as the toner density decreases, the falling gradient of the signal corresponding to a portion where a transition occurs from the intermediate transfer belt 31 to the registration correction pattern 70 becomes more moderate. In contrast, the rising gradient of the signal corresponding to a portion where a transition occurs from the registration correction pattern 70 to the intermediate transfer belt 31 becomes steeper. Under this condition, therefore, the above influence becomes noticeable. That is, a shift amount Y of the midpoint M' obtained based on the outputs from the photosensors 60 and 61 increases relative to the midpoint M of the ideal pattern. This causes misalignment even after registration correction.

In an image forming apparatus with a density specification for images being set to 1.2±0.2, both a density of 1.4 and a density of 1.0 can satisfy the criterion for density. For the above reason, however, when the density decreases, the color misalignments between the respective toner images may fall outside the corresponding specification at the time of image transfer even if the density falls within the criterion range.

(1) in FIG. 8 indicates a state in which the density is 1.4, and the midpoint of the registration correction pattern can be accurately detected (M=M'). When the density decreases to 1.2 as indicated by (2) in FIG. 8, however, M≠M', and the shift becomes Y1. When the density further decreases to 1.0 as indicated by (3) in FIG. 8, M≠M', and the shift becomes Y2. In this manner, the position M' shifted from the midpoint M of the actual registration correction pattern is erroneously recognized as a midpoint. That is, the registration correction position for each color shifts from the proper position by Y1 and Y2 shown in FIG. 8. Even if, therefore, the image forming apparatus have undergone accurate color misalignment correction in the initially installed state, as the durability deteriorates, and the correction accuracy deteriorates. This may lead to a deterioration in image quality.

Therefore, in a state in which the durability has deteriorated in this manner, in order to accurately execute registration correction, it is necessary to form a registration correction pattern with a high density. As a method for this operation, a method of forming such a pattern by increasing a laser light amount is conceivable. If, however, an excessive amount of laser light is always applied in operation including printing operation, the charge of the latent image formed on the photosensitive drum may not be sufficiently eliminated. This may adversely influence the next printed image or cause early deterioration in the photosensitive drum. For this reason, the light amount to be applied need to fall within a predetermined range at the time of printing.

The present invention, therefore, sets different light amounts, for each color corresponding to each image forming unit, as a light amount (first light amount) when a registration correction pattern is to be formed (that is, when misalignments are to be detected) and a light amount (second light amount) when printing is to be performed. In addition, the upper limit value in the set range of laser beam light amounts at the time of the formation of a registration correction pattern is set to be higher than that in the set range of laser beam light amounts at the time of printing.

Figure 9:
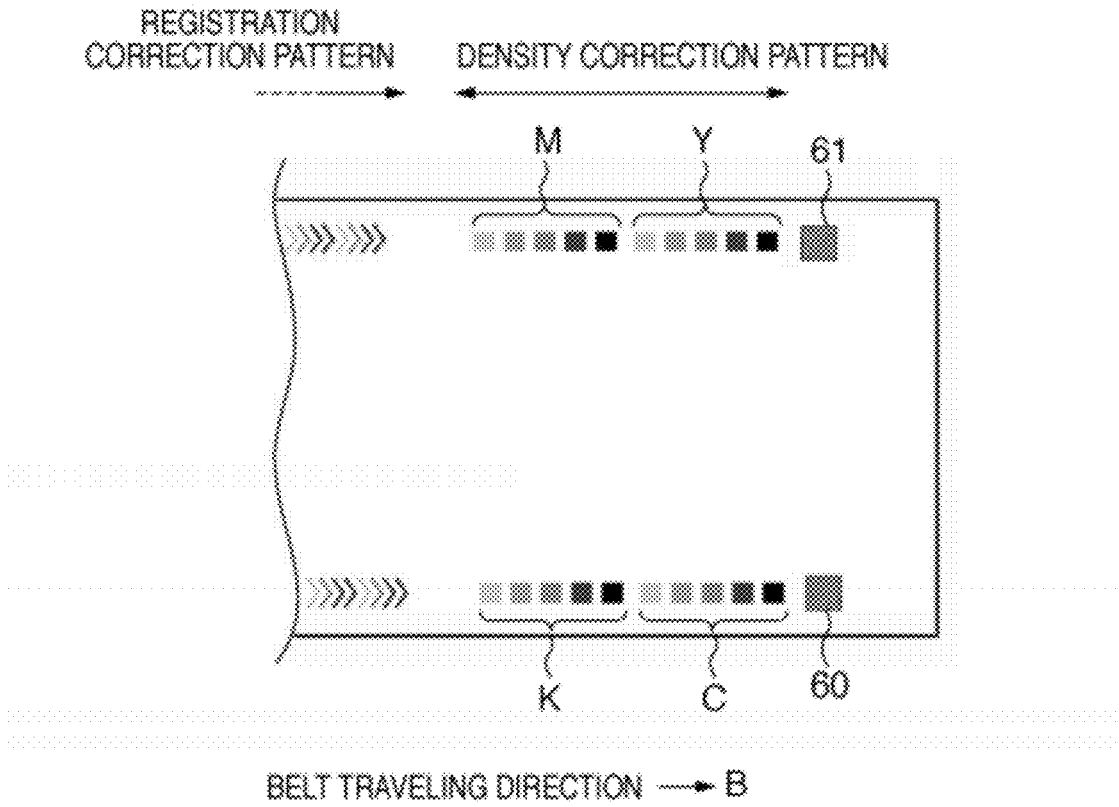
FIG. 9 is a view showing the formation of a registration correction pattern and density correction pattern.
Figure 10:
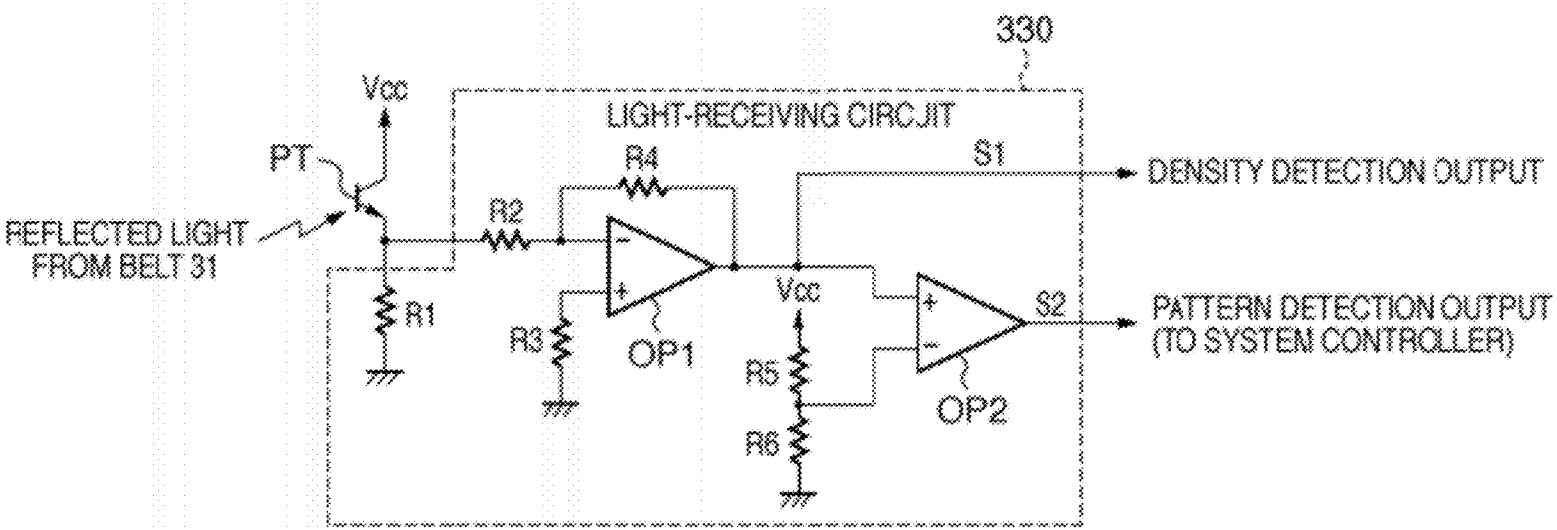
FIG. 10 is a circuit diagram showing a light-receiving circuit which converts the light detected by a phototransistor into an electrical signal.

This operation will be described in detail with reference to FIG. 9. As shown in FIG. 9, before the formation of registration correction patterns for the respective colors, that is, Y, M, C, and Bk, density correction patterns are formed. This embodiment generates density correction patterns by using the same unit as that for the registration correction patterns described above. Therefore, the density pattern forming unit is identical to the pattern forming unit. In this case, the shapes and arrangements of registration correction patterns and density correction patterns may be defined to improve the respective detection accuracies and the like. In addition, in this embodiment, the photosensors 60 and 61 detect both a registration correction pattern and a density correction pattern. Therefore, the density pattern reading unit is identical to the pattern reading unit. However, the image forming apparatus may include these units as different means. For example, different sensors may be installed for the respective means. At this time, the formation positions of the respective patterns formed by the density pattern forming unit and the pattern forming unit are changed in accordance with the installation positions of the sensors. It is also possible to change the locations of the photosensors 60 and 61 in accordance with the portions (the intermediate transfer belt or the transfer material convey belt) on which registration correction patterns and density correction patterns are formed. As shown in FIG. 10, in the light-receiving circuit 330, a resistor R1 converts the photocurrents detected from the photosensors 60 and 61 into voltages, and resistors R2 to R4 and an operational amplifier OP1 amplify the voltages. A density detection signal S1 is generated in this manner and is output to the system controller 101.

Note that the system controller 101 also receives a pattern detection signal S2 generated as a LOW or HIGH signal as a result of comparison between a voltage converted from a photocurrent by a comparator OP2 and a predetermined voltage. As shown in FIG. 9, this embodiment generates density tone patterns for the respective colors, that is, Y, M, C, and Bk, by changing a laser light amount in predetermined five steps. The range of laser light amounts has 256 steps from 00 to FF. Light amount set values for the formation of registration correction patterns are sequentially set to higher values, that is, 40, 60, 80, A0, and C0, for each color, with the maximum set value (the upper limit value of light amounts which correspond to registration correction patterns) being set to C0 at most. Note that light amount set values are laser light amounts for the formation of toner images based on image data input from an external apparatus or a reading apparatus or toner images as registration correction patterns, and differ in their control ranges for the respective light amounts. Laser light amounts for the respective toner images are controlled within light amount set values in predetermined ranges so as to cope with the state of the image forming apparatus and variations in the environment in which the image forming apparatus is placed. In this case, a maximum set value is the maximum light amount among the laser light amount set values corresponding to each toner image. For example, the image forming apparatus of this embodiment forms a registration correction pattern with one of light amounts of 40, 60, 80, A0, and C0, and the corresponding ON duty being set to 100%.

ON duties will be described below. A driving signal (PWM signal) for emitting laser light is supplied to the laser emitting unit 310. A PWM signal is a pulse signal generated based on image data input from an external apparatus or a reading apparatus. The width (ON duty) of a pulse contained in this PWM signal is determined by image data. For example, for image data which entirely covers a region corresponding to one pixel on a transfer material with a toner image, a pulse with an ON duty of 100% is generated. For image data which covers 80% of a region corresponding to one pixel on a transfer material, a pulse with an ON duty of 80% is generated. The laser emitting unit 310 is turned on for a time corresponding to the ON duty of a pulse contained in a PWM signal.

[Calculation of Laser Light Amount]

Figure 11A:
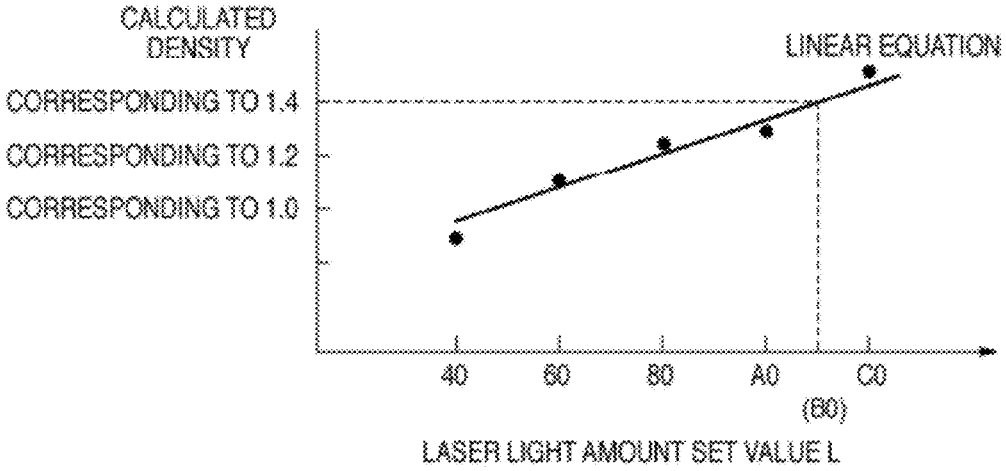
FIGS. 11A and 11B are graphs each showing a relationship in the calculation of laser light amount set values.

FIG. 11A is a graph for explaining a method of calculating a laser light amount at the time of registration correction. The abscissa represents a laser light amount set value L at the time of the generation of a registration correction pattern. The ordinate represents the pattern density obtained by reading the density pattern generated by each laser light amount set value. The ROM 101*b* in the system controller stores the relationship between density detection outputs from each photosensor and densities in advance as a table. A density detection output from each photosensor is therefore converted into a density by referring to the table.

As shown in FIG. 11A, the system controller 101 generates an approximate linear equation of densities by switching a laser light amount set value. This embodiment generates an approximate linear equation by switching the light amount set value L in five steps (40, 60, 80, A0, and C0). However, the present invention is not limited to this. It is possible to properly set the number of steps in switching of the light amount set value and the intervals of the steps in accordance with the characteristics of the laser. A laser light amount as a target density is derived from this generated approximate linear equation. The target density in this embodiment is 1.4, and a laser light amount set value for implementing the target density is B0. The system controller determines laser light amount set values L1Y, L1M, L1C, and L1Bk at the registration correction independently for the respective colors in the above manner. The set values are used only when registration correction is performed. On the other hand, in the image forming apparatus of this embodiment, the upper limit value of the light amount set range at the time of printing is set to be 80 so as to avoid any troubles in the image forming apparatus.

Figure 11B:
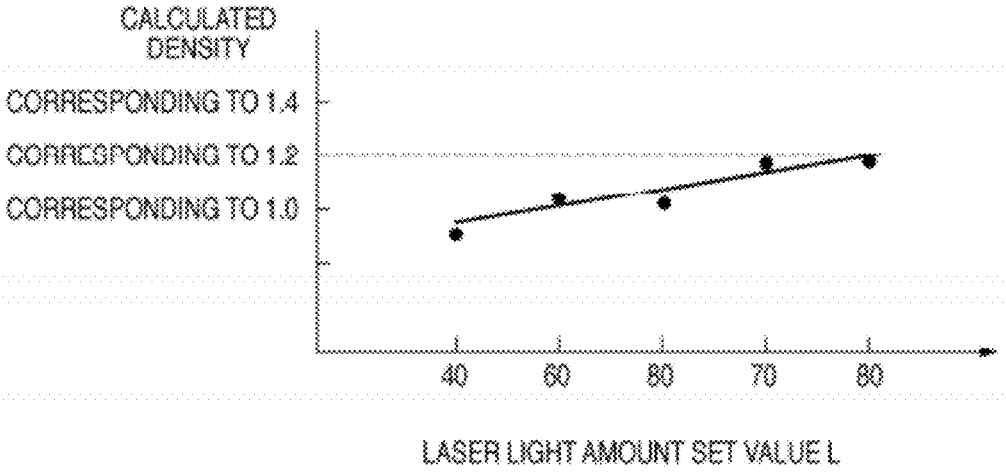

Referring to FIG. 11B, like FIG. 11A, the abscissa represents the laser light amount set value L at the time of printing, and the ordinate represents the densities obtained by reading density patterns generated by the respective laser light amount set values. In the image forming apparatus of this embodiment, the density specification is 1.2±0.2, and control is performed in a high density region to obtain a density as close to 1.4 as possible within the density specification. As described above, however, the upper limit value of laser light amounts at the time of printing is set to 80, a set value exceeding 80 cannot be a set value. In the case shown in FIG. 11B, therefore, the laser light amount set value L at the time of printing is set to 80, and the maximum density in this case is about 1.2. That is, with regard to tone at the time of printing, for a maximum density portion, it is possible to output a density up to 1.2 by setting the ON duty of laser light per pixel to 100%, whereas for a low density portion, tone is expressed by decreasing the ON duty of laser light. In the above manner, this apparatus determines laser light amount set values L2Y, L2M, L2C, and L2Bk at the time of printing independently for the respective colors, and uses the set values when performing printing operation.

[Control Procedure]

Figure 12:
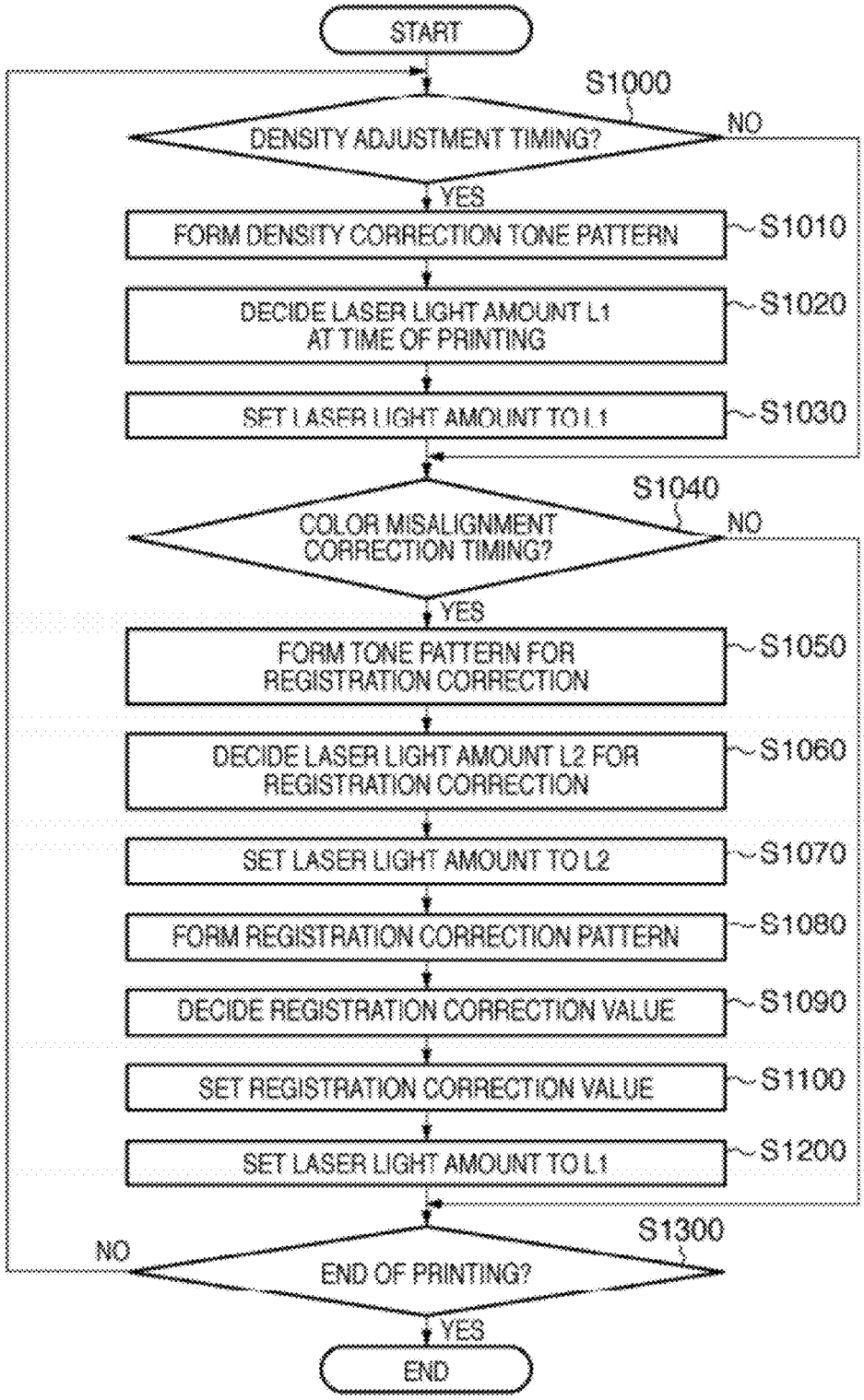
FIG. 12 is a flowchart according to the first embodiment.

The above control operation will be described in detail below with reference to the flowchart of FIG. 12. Note that the CPU 101*a* in the system controller 101 comprehensively executes the flowchart to be described below. In addition, to implement the following procedure, in this embodiment, the CPU 101*a* reads out and executes programs stored in a storage unit such as the ROM 101*b*.

When a print job is input to this apparatus in the sleep or standby mode, the CPU 101*a* determines before printing operation whether the current timing is the timing to execute density adjustment at the time of printing (S1000). In this case, the density at the time of printing varies depending on the accumulated number of print jobs after the previous execution of density adjustment, variations in the environment in which the image forming apparatus is installed, and the like. In this embodiment, the CPU 101*a* determines the timing to execute density adjustment at the time of printing based on the accumulated number of printed sheets after the previous execution of density adjustment and the elapsed time since the previous printing operation. If the current timing is not the timing to execute density adjustment (NO in step S1000), the process advances to step S1040. If the current timing is the timing to execute density adjustment (YES in step S1000), the CPU 101*a* forms density correction patterns while switching each of the laser light amounts for Y, M, C, and Bk in five steps, that is, 40, 50, 60, 70, and 80 (S1010). By using the results obtained by reading the respective density correction patterns, the CPU 101*a* decides on the laser light amounts L1, that is, L1Y, L1M, L1C, and L1Bk, for achieving target densities at the time of printing of each color (S1020).

The CPU 101*a* stores the decided laser light amounts L1 for the respective colors in the RAM 101*c* in the system controller 101, and sets them as light amounts used for printing operation (S1030). That is, when obtaining a profile corresponding to an approximate linear equation like that shown in FIG. 11B, the CPU 101*a* sets the laser light amount set value to 80.

The CPU 101*a* then determines whether the current timing is the timing to execute registration correction (S1040). The CPU 101*a* also determines, based on the accumulated number of print jobs, environmental variations, and the like, whether the current timing is the timing to execute registration correction. If the current timing is not the timing to execute registration correction (NO in step S1040), the process advances to step S1300. If the current timing is the timing to execute registration correction (YES in step S1040), the CPU 101*a* performs control to derive laser light amounts at the time of the generation of registration correction patterns before the formation of the registration correction patterns.

First of all, the CPU 101*a* forms density correction patterns while switching each of laser light amounts for Y, M, C, and Bk in five steps, that is, 40, 60, 80, A0, and C0 (S1050). Based on the results obtained by reading these density correction patterns, the CPU 101*a* decides on the laser light amounts L2, that is, L2Y, L2M, L2C, and L2Bk, for achieving target densities at the time of registration correction for the respective colors (S1060). That is, when obtaining a profile corresponding to an approximate linear equation like that shown in FIG. 11A, the CPU 101*a* sets the laser light amount set value at the time of the formation of registration correction patterns to B0. The CPU 101*a* stores the decided laser light amounts L2 for the respective colors in the RAM 101*c* in the system controller 101, and sets them as light amount values used for registration correction (S1070).

The CPU 101*a* forms registration correction patterns for the respective colors by using the laser light amounts L2Y, L2M, L2C, and L2Bk decided in the above manner (S1080). Based on the results obtained by reading these registration correction patterns, the CPU 101*a* decides registration correction values for the respective colors (S1090). The CPU 101*a* stores the decided registration correction values for the respective colors in the RAM 101*c* in the system controller 101, and also corrects the image write timings in main scanning and sub-scanning by using the correction values at the time of printing (S1100). Upon completing the registration correcting operation, the CPU 101*a* switches the laser light amounts for the respective colors from the set values L2Y, L2M, L2C, and L2Bk at the time of registration correction to the set values L1Y, L1M, L1C, and L1Bk at the time of printing (S1200). The CPU 101*a* then generates printed images by using the laser light amounts L1Y, L1M, L1C, and L1Bk, and shifts to the standby or sleep state upon completion of all the printing operations (S1300).

As described above, the laser light amounts at the time of registration correction are set to be higher than those at the time of printing. This makes it possible to keep the density of each registration correction pattern proper and to always accurately execute registration correction.

Second Embodiment

In the first embodiment, when laser light amounts are independently set for printing operation and registration correction, the delay times of detection signals from the BD sensor 314 relative to the synchronization of main scanning of laser beams may differ from each other. This delay time is the delay time from the instant laser light strikes the BD sensor 314 to the instant the BD sensor 314 outputs a main scan start signal S12. This delay time difference may cause a shift in the write timing in the main scanning direction at the time of printing.

Figure 14A:
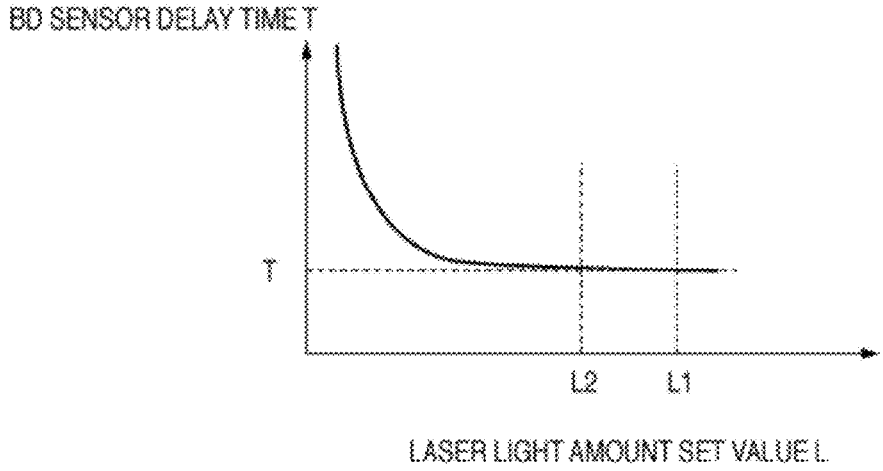
FIGS. 14A and 14B are graphs each showing the delay time of a main scan synchronization signal relative to a laser light amount.

FIG. 14A shows a case in which even when a laser light amount L1 at the time of registration correction and a laser light amount L2 at the time of printing are respectively set to different light amounts, a delay time T of the BD sensor 314 remains unchanged. In such a case, the above shift does not occur in the write timing in the main scanning direction.

Figure 14B:
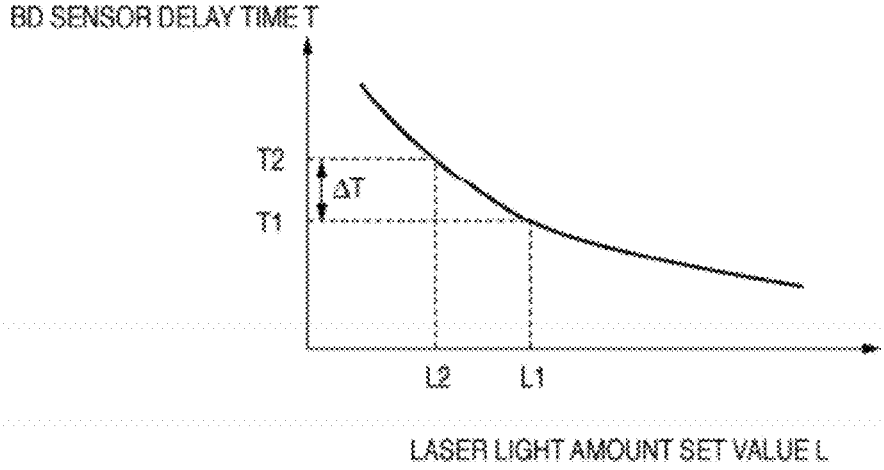

For the following reasons, however, as shown in FIG. 14B, a write timing shift occurs in the main scanning direction. Referring to FIG. 14B, if the laser light amount L1 is set at the time of registration correction, a delay time T1 elapses before the BD sensor 314 outputs the main scan start signal S12. If the laser light amount L2 is set at the time of printing, a delay time T2 elapses. Letting V be the scanning velocity of laser light, a distance X1 that laser light travels in the main scanning direction during the interval from the instant light strikes the BD sensor 314 to the instant the BD sensor 314 outputs the main scan start signal S12 at the time of registration correction is given by $$X1=V\times T1 \quad (1)$$

Likewise, a distance X2 that laser light travels in the main scanning direction during the interval from the instant light strikes the BD sensor 314 to the instant the BD sensor 314 outputs a main scan start signal at the time of printing is given by $$X2=V\times T2 \quad (2)$$

That is, the write timing in main scanning shifts by a difference ΔX(|X1−|X2|) between the distances X1 and X2.

If, for example, delay time T1=10 ns, delay time T2=30 ns, and laser scanning velocity V=1,500,000 mm/sec, then $$X1=10\ (\text{ns})\times 1{,}500{,}000\ (\text{mm/sec})=15\ (\mu\text{m})$$

$$X2=30\ (\text{ns})\times 1{,}500{,}000\ (\text{mm/sec})=45\ (\mu\text{m})$$

$$\Delta X=45-15=30\ (\mu\text{m})$$

That is, the write position at the time of printing shifts forward by 30 μm relative to the write position set at registration adjustment. In this case, the laser light amount L1 at the time of registration correction and the laser light amount L2 at the time of printing change every time adjusting operation is executed. In addition, such laser light amounts are independently set for the respective colors. Therefore, color misalignment may become noticeable as described below.

Figure 15A:
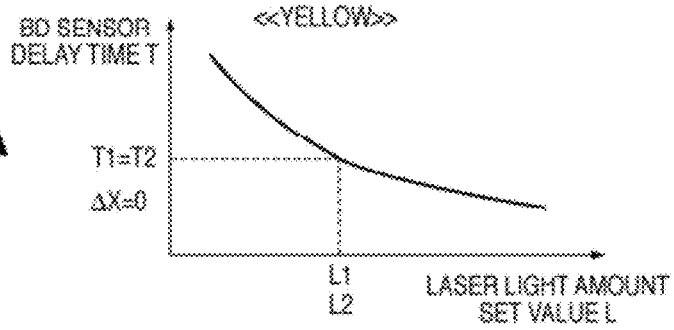
FIGS. 15A, 15B, 15C, and 15D are graphs each showing the delay time of a main scan synchronization signal relative to a laser amount in each color component.

Assume that the laser light amount L1 at the time of registration correction for each color and the laser light amount L2 at the time of printing are set, as shown in FIGS. 15A to 15D. As shown in FIG. 15A, if the laser light amounts for yellow have a relationship represented by L1=L2, the delay time of the BD sensor 314 is represented by T1=T2. For this reason, the write position at the time of printing coincides with the position set by registration correction (ΔV=0).

Figure 15B:
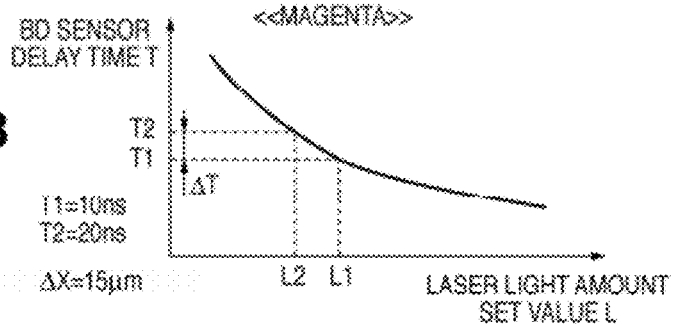

In contrast, assume that laser light amounts for magenta have a relationship represented by L1≠L2, the delay times of the BD sensor 314 are respectively given by T1=10 ns and T2=20 ns, and laser scanning velocity V=1,500,000 mm/sec, as shown in FIG. 15B. In this case, the write position at the time of printing shifts in the main scanning direction as described below.

$$\Delta X=(20\ (\text{ns})-10\ (\text{ns}))\times 1{,}500{,}000\ (\text{mm/sec})=15\ (\mu\text{m})$$

Figure 15C:
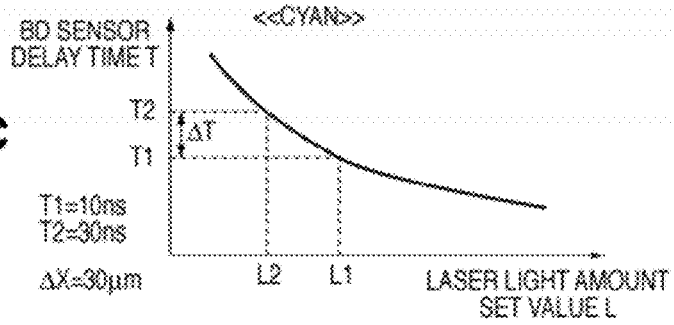

Likewise, assume that for cyan, T1=10 ns, T2=30 ns, and V=1,500,000 mm/sec, as shown in FIG. 15C. In this case, the write position at the time of printing shifts in the main scanning direction as follows.

$$\Delta X=(30\ (\text{ns})-10\ (\text{ns}))\times 1{,}500{,}000\ (\text{mm/sec})=30\ (\mu\text{m})$$

Figure 15D:
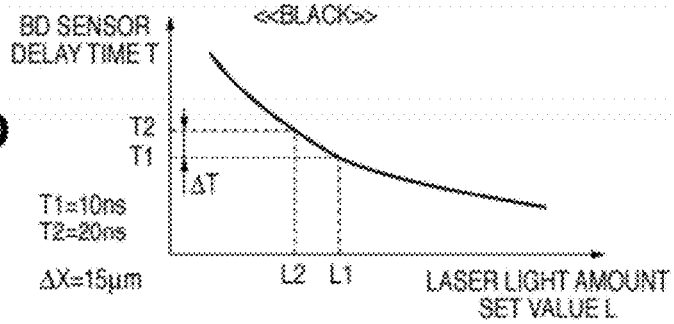

Likewise, assume that for black, T1=10 ns, T2=30 ns, and V=1,500,000 mm/sec, as shown in FIG. 15D. In this case, the write position at the time of printing shifts in the main scanning direction as follows.

$$\Delta X=(30\ (\text{ns})-20\ (\text{ns}))\times 1{,}500{,}000\ (\text{mm/sec})=15\ (\mu\text{m})$$

Figure 16A:
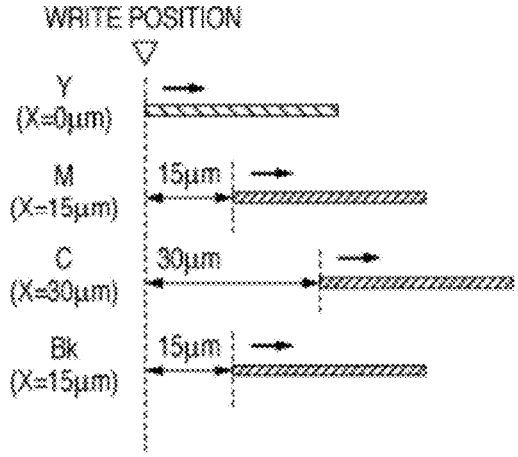
FIGS. 16A and 16B are views for explaining the main scanning shift of a main scan synchronization signal relative to a delay time.

FIG. 16A shows the relationship between the positional shifts of yellow, magenta, cyan, and black images in the main scanning direction at the time of printing when the main scanning directions of the images of the respective colors are the same. That is, the maximum positional shift between the images of the respective colors in the main scanning direction is 30 μm between the images of yellow Y and cyan C.

Figure 16B:
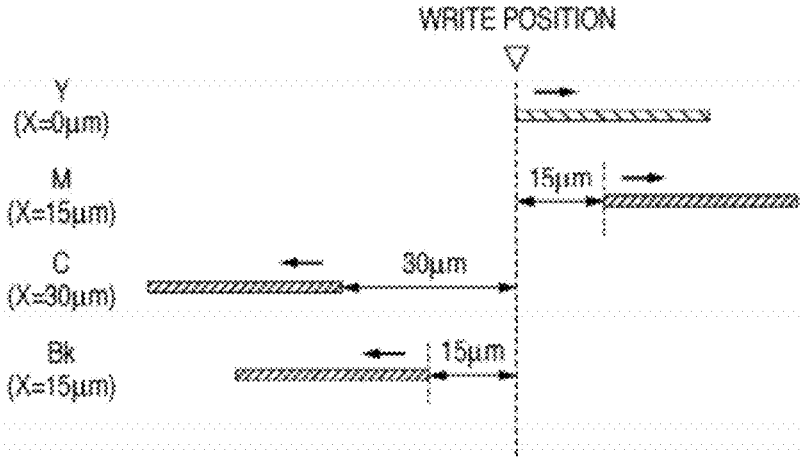

Assume that yellow, magenta, cyan, and black images are in an optical positional relationship in which the main scanning directions of the yellow and magenta images are the same, and the main scanning directions of the cyan and black images intersect those of the yellow and magenta images. FIG. 16B shows the relationship between positional shifts between the images of the respective colors in the main scanning direction. That is, the maximum positional shift among the images of the respective colors in the main scanning direction is 45 μm between the cyan and magenta images.

When each laser unit is designed to be reduced in size, the main scanning directions of laser light may be designed to intersect each other for the sake of placement. In this case, the positional shifts between the images of the respective colors in the main scanning direction become more noticeable as described with reference to FIG. 16B.

In this embodiment, therefore, a relational expression of the delay time T of the BD sensor 314 relative to a change in the laser light amount L, like that shown in FIGS. 14A and 14B, is stored in the system controller 101 of the image forming apparatus in advance. This makes it possible to calculate the delay time ΔT of the BD sensor 314, based on the difference between the laser light amounts L1 and L2, by using the relational expression.

An offset amount corresponding to the delay time ΔT calculated in this manner is added to a registration correction value in the main scanning direction. This prevents the occurrence of misalignment in the main scanning direction at the time of printing and allows accurate registration correction even if the delay time ΔT of the BD sensor 314 changes due to the difference between a laser light amount at the time of registration correction and a laser light amount at the time of printing.

Note that the above description has exemplified the apparatus which includes the BD sensors 314 corresponding to all laser beams for Y, M, C, and K and controls write timings based on signals from the BD sensors 314. However, an apparatus which includes the BD sensor 314 for only laser light for a specific color may add an offset value like that described above for only the laser light for the color. That is, the present invention can be applied to any apparatus which includes one or more BD sensors 314.

Figure 17:
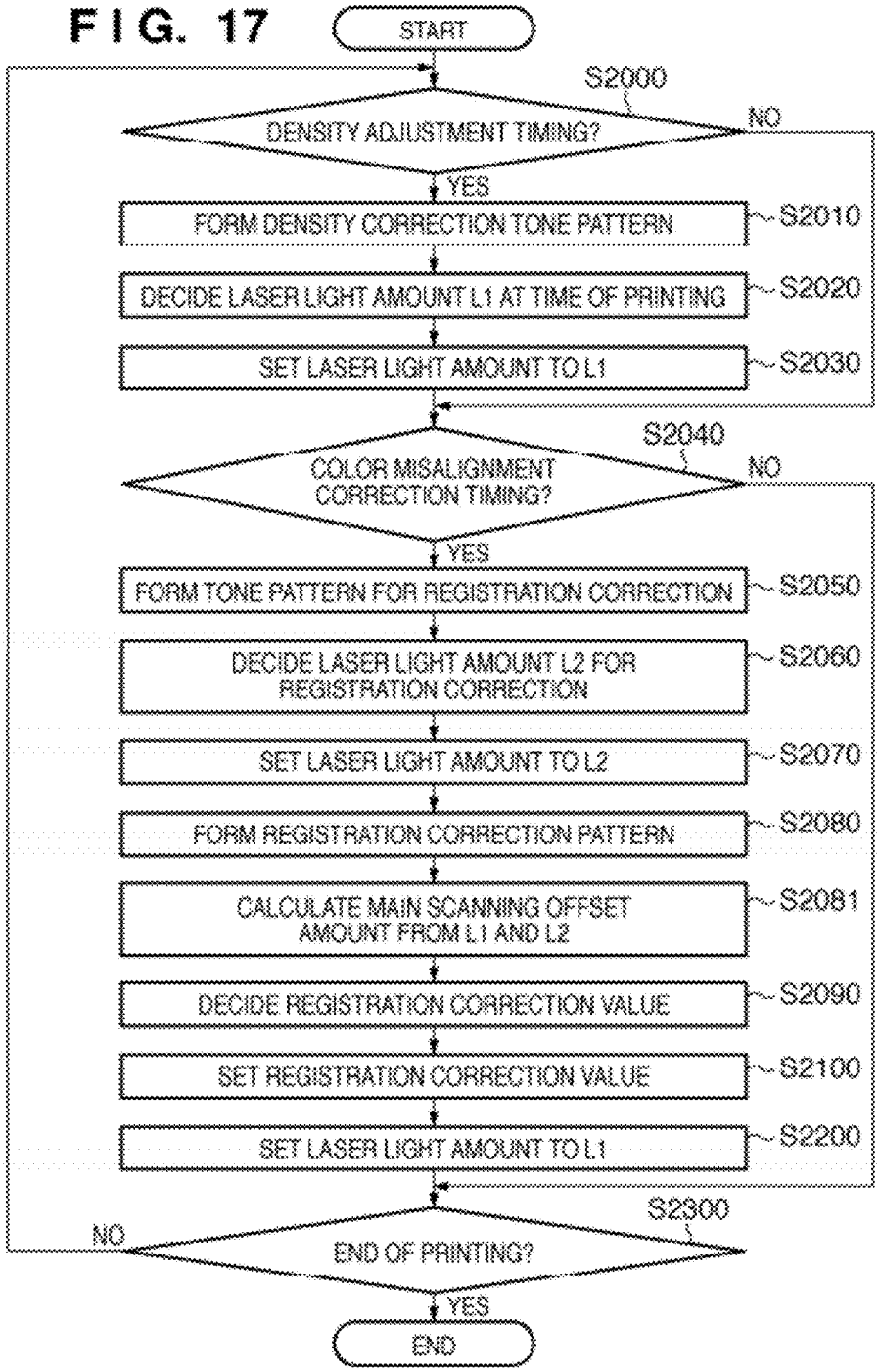
FIG. 17 is a flowchart according to the second embodiment.

The above control operation will be described in detail below with reference to the flowchart of FIG. 17. Note that a CPU 101*a* in a system controller 101 comprehensively executes the flowchart to be described below. In addition, to implement the procedure to be described below, in this embodiment, the CPU 101*a* reads out and executes programs stored in a storage unit such as a ROM 101*b*.

When a print job is input to this apparatus in the sleep or standby mode, the CPU 101*a* determines before printing operation whether the current timing is the timing to execute density adjustment at the time of printing (S2000). In this case, the density at the time of printing varies depending on the accumulated number of print jobs after the previous execution of density adjustment, variations in the environment in which the image forming apparatus is installed, and the like. In this embodiment, the CPU 101*a* determines the timing to execute density adjustment at the time of printing based on the accumulated number of printed sheets after the previous execution of density adjustment and the elapsed time since the previous printing operation.

If the current timing is the timing to execute density adjustment (YES in step S2000), the CPU 101*a* forms density correction patterns while switching each of the laser light amounts for Y, M, C, and Bk in five steps, that is, 40, 50, 60, 70, and 80 (S2010). By using the results obtained by reading the respective density correction patterns, the CPU 101*a* decides laser light amounts L1, that is, L1Y, L1M, L1C, and L1Bk, for achieving target densities at the time of printing of each color (S2020).

The CPU 101*a* stores the decided laser light amounts L1 for the respective colors in the RAM 101*c* in the system controller 101, and sets them as laser light amounts used for printing operation (S2030). That is, when obtaining a profile corresponding to an approximate linear equation like that shown in FIG. 11B, the CPU 101*a* sets the laser light amount set value to 80.

The CPU 101*a* then determines whether the current timing is the timing to execute registration correction (S2040). The CPU 101*a* also determines, based on the accumulated number of print jobs, environmental variations, and the like, whether the current timing is the timing to execute registration correction. If the current timing is not the timing to execute registration correction (NO in step S2040), the process advances to step S2300.

If the current timing is the timing to execute registration correction (YES in step S2040), the CPU 101*a* performs control to derive laser light amounts at the time of the generation of registration correction patterns before the formation of the registration correction patterns. First of all, the CPU 101*a* forms density correction patterns while switching each of laser light amounts for Y, M, C, and Bk in five steps, that is, 40, 60, 80, A0, and C0 (S2050). Based on the results obtained by reading these density correction patterns, the CPU 101*a* decides on the laser light amounts L2, that is, L2Y, L2M, L2C, and L2Bk, for achieving target densities at the time of registration correction for the respective colors (S2060). That is, when obtaining a profile like that shown in FIG. 11A, the CPU 101*a* sets the laser light amount set value at the time of the formation of registration correction patterns to B0.

The CPU 101*a* stores the decided laser light amounts L2 for the respective colors in the RAM 101*c* in the system controller 101, and sets them as laser light amounts used for registration correction (S2070). The CPU 101*a* forms registration correction patterns for the respective colors by using the laser light amounts L2Y, L2M, L2C, and L2Bk decided in the above manner (S2080). Based on the results obtained by reading these registration correction patterns, the CPU 101*a* calculates registration correction values for the respective colors. The CPU 101*a* then calculates offset values relative to the write position in the main scanning direction from the differences between laser light amounts L1 and L2 (S2081). The CPU 101*a* decides registration correction values for the respective colors from the calculated values (S2090).

The CPU 101*a* stores the decided registration correction values for the respective colors in the RAM 101*c* in the system controller 101, and also corrects the image write timings in main scanning and sub-scanning by using the correction values at the time of printing (S2100). Upon completing the registration correcting operation, the CPU 101*a* switches the laser light amounts for the respective colors from the laser light amounts L1Y, L1M, L1C, and L1Bk at the time of registration correction to the laser light amounts L2Y, L2M, L2C, and L2Bk at the time of printing (S2200). The CPU 101*a* then generates printed images by using the laser light amounts L2Y, L2M, L2C, and L2Bk, and shifts to the standby or sleep state upon completion of all the printing operations (S2300).

With the above operation, it is possible to perform accurate registration correction even if the delay amounts of detection signals from the BD sensors differ from each other due to the differences in light intensity between laser light amounts at the time of registration correction and laser light amounts at the time of printing.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-181856, filed Aug. 16, 2010, which is hereby incorporated by reference herein in its entirety.

What is claimed is:

1. An image forming apparatus comprising:

an image forming unit including a plurality of photosensitive members, an exposure unit configured to irradiate each of the plurality of photosensitive members with a corresponding light beam, a light amount control unit configured to control a light amount of the light beams emitted from the exposure unit, a plurality of developing units configured to develop electrostatic latent images, formed on the plurality of photosensitive members by exposure with the light beams, by using different toners, and a transfer unit configured to transfer toner images formed on the plurality of photosensitive members onto an image carrier;

a pattern forming unit configured to control the image forming unit to form, on the image carrier, a misalignment detection pattern for detecting a relative misalignment between the toner images transferred onto the image carrier from the plurality of photosensitive members;

a pattern reading unit configured to read the misalignment detection pattern; and a correction unit configured to correct the relative misalignment between the toner images based on the reading result obtained by the pattern reading unit, wherein the light amount control unit controls the light amount of the light beams which are exposed on the photosensitive members to a first light amount in order to form the misalignment detection pattern, and controls the light amount of the light beams to a second light amount in order to form an image based on image data from an external apparatus or a reading apparatus, wherein the first light amount is greater than the second light amount, and wherein when the second light amount is controlled to an upper limit value, the light amount control unit controls the first light amount to a light amount greater than the upper limit value in order to form the misalignment detection pattern.

2. The apparatus according to claim 1, wherein the image forming unit further comprises a deflection unit configured to deflect the light beams emitted from the exposure unit so as to scan the photosensitive members with the light beams, and not less than one synchronization signal output unit configured to output a synchronization signal in accordance with receiving the light beams deflected by the deflection unit, and wherein the light amount control unit controls the exposure unit so as to make the synchronization signal output unit receive the light beams of the first light amount, in a case where the image forming unit forms the misalignment detection pattern, and controls the exposure unit so as to make the synchronization signal output unit receive the light beams of the second light amount, in a case where the image forming unit forms the image based on the image data.

3. The apparatus according to claim 2, wherein the correction unit adds an offset value, which is correction data for correcting a write position of the image, corresponding to a difference between the first light amount and the second light amount to correction data for correcting a relative misalignment between the toner images based on the reading result obtained by the reading unit, and corrects the relative misalignment between the toner images based on the data to which the offset value is added.

4. The apparatus according to claim 1, wherein the pattern forming unit forms a plurality of density correction patterns with different densities on the image carrier by changing the light amount of the light beams, and controls the image forming unit so as to form the density correction patterns before formation of the misalignment detection pattern, and wherein the light amount control unit controls the first light amount so as to form the misalignment detection pattern with a target density based on the reading result of the density correction pattern read by the pattern reading unit.

5. The apparatus according to claim 1, further comprising a storage unit configured to store data related to the upper limit value.

6. The apparatus according to claim 5, wherein the pattern forming unit is configured to control the image forming unit to form, on the image carrier, a detection pattern for controlling the second light amount of the light beams for forming the image based on the image data input from the external apparatus or the reading apparatus, and controls the second light amount of the light beams for forming the image based on the image data input from the external apparatus or the reading apparatus based on a reading result of the detection pattern obtained by the pattern reading unit.

7. An image forming apparatus comprising:

an image forming unit including a plurality of photosensitive members, an exposure unit configured to irradiate each of the plurality of photosensitive members with a corresponding light beam, a light amount control unit configured to control a light amount of the light beams emitted from the exposure unit, a plurality of developing units configured to develop electrostatic latent images, formed on the plurality of photosensitive members by exposure with the light beams, by using different toners, and a transfer unit configured to transfer toner images formed on the plurality of photosensitive members onto an image carrier;

a pattern forming unit configured to control the image forming unit to form, on the image carrier, a misalignment detection pattern for detecting a relative misalignment between the toner images transferred onto the image carrier from the plurality of photosensitive members;

a pattern reading unit configured to read the misalignment detection pattern; and a correction unit configured to correct the relative misalignment between the toner images based on the reading result obtained by the pattern reading unit, wherein the light amount control unit is configured to control a maximum light amount of a first light amount of the light beams for forming the misalignment detection pattern to be higher than a maximum light amount of a second light amount of the light beams for forming an image based on image data input from an external apparatus or a reading apparatus.

8. The apparatus according to claim 7, wherein the image forming unit further comprises a deflection unit configured to deflect the light beams emitted from the exposure unit so as to scan the photosensitive members with the light beams, and not less than one synchronization signal output unit configured to output a synchronization signal in accordance with receiving the light beams deflected by the deflection unit, and wherein the light amount control unit controls the exposure unit so as to make the synchronization signal output unit receive the light beams of the first light amount for forming the misalignment detection pattern, in a case where the image forming unit forms the misalignment detection pattern, and controls the exposure unit so as to make the synchronization signal output unit receive the light beams of the second light amount for forming the image based on image data, in a case where the image forming unit forms an image based on the image data.

9. The apparatus according to claim 8, wherein in a case where the first light amount and the second light amount are controlled to be different light amounts, the correction unit adds an offset value, which is correction data for correcting a write position of the image, corresponding to a difference between the first light amount and the second light amount to correction data for correcting a relative misalignment between the toner images based on the reading result obtained by the reading unit, and corrects the relative misalignment between the toner images based on the data to which the offset value is added.

10. The apparatus according to claim 7, wherein the pattern forming unit forms a plurality of density correction patterns with different densities on the image carrier by changing the light amount of the light beams, and controls the image forming unit so as to form the density correction patterns before formation of the misalignment detection pattern, and wherein the light amount control unit sets the first light amount of the light beams for forming the misalignment detection pattern so as to form the misalignment detection pattern with a target density based on the reading result of the density correction pattern read by the pattern reading unit.

11. The apparatus according to claim 7, further comprising a storage unit configured to store data related to the maximum light amounts of the light amounts of the light beams for forming the image based on the image data input from the external apparatus or the reading apparatus.

12. The apparatus according to claim 11, wherein the pattern forming unit is configured to control the image forming unit to form, on the image carrier, a detection pattern for controlling the second light amount of the light beams for forming the image based on the image data input from the external apparatus or the reading apparatus, and controls the second light amount of the light beams for forming the image based on the image data input from the external apparatus or the reading apparatus based on a reading result of the detection pattern obtained by the pattern reading unit.

13. An image forming apparatus comprising:

an image forming unit including a plurality of photosensitive members, an exposure unit configured to irradiate each of the plurality of photosensitive members with a corresponding light beam, a light amount control unit configured to control a light amount of the light beams emitted from the exposure unit, a plurality of developing units configured to develop electrostatic latent images, formed on the plurality of photosensitive members by exposure with the light beams, by using different toners, and a transfer unit configured to transfer toner images formed on the plurality of photosensitive members onto a transfer material conveyed by a conveyor;

a pattern forming unit configured to control the image forming unit to form, on the conveyor, a misalignment detection pattern for detecting a relative misalignment between the toner images transferred onto the transfer material from the plurality of photosensitive members;

a pattern reading unit configured to read the misalignment detection pattern; and a correction unit configured to correct the relative misalignment between the toner images based on the reading result obtained by the pattern reading unit, wherein the light amount control unit controls the light amount of the light beams which are exposed on the photosensitive members to a first light amount in order to form the misalignment detection pattern, and controls the light amount of the light beams to a second light amount in order to form an image based on image data from an external apparatus or a reading apparatus, wherein the first light amount is greater than the second light amount, and wherein when the second light amount is controlled to an upper limit value, the light amount control unit controls the first light amount to a light amount greater than the upper limit value in order to form the misalignment detection pattern.

14. The apparatus according to claim 13, wherein the image forming unit further comprises a deflection unit configured to deflect the light beams emitted from the exposure unit so as to scan the photosensitive members with the light beams, and not less than one synchronization signal output unit configured to output a synchronization signal in accordance with receiving the light beams deflected by the deflection unit, and wherein the light amount control unit controls the exposure unit so as to make the synchronization signal output unit receive the light beams of the first light amount, in a case where the image forming unit forms the misalignment detection pattern, and controls the exposure unit so as to make the synchronization signal output unit receive the light beams of the second light amount, in a case where the image forming unit forms the image based on the image data.

15. The apparatus according to claim 14, wherein the correction unit adds an offset value, which is correction data for correcting a write position of the image, corresponding to a difference between the first light amount and the second light amount to correction data for correcting a relative misalignment between the toner images based on the reading result obtained by the reading unit, and corrects the relative misalignment between the toner images based on the data to which the offset value is added.

16. The apparatus according to claim 13, wherein the pattern forming unit forms a plurality of density correction patterns with different densities on the conveyor by changing the light amount of the light beams, and controls the image forming unit so as to form the density correction patterns before formation of the misalignment detection pattern, and wherein the light amount control unit controls the first light amount so as to form the misalignment detection pattern with a target density based on the reading result of the density correction pattern read by the pattern reading unit.

17. An image forming apparatus comprising:

an image forming unit including a plurality of photosensitive members, an exposure unit configured to irradiate each of the plurality of photosensitive members with a corresponding light beam, a light amount control unit configured to control a light amount of the light beams emitted from the exposure unit, a plurality of developing units configured to develop electrostatic latent images, formed on the plurality of photosensitive members by exposure to the light beams, by using different toners, and a transfer unit configured to transfer toner images formed on the plurality of photosensitive members onto a transfer material conveyed by a conveyor;

a pattern forming unit configured to control the image forming unit to form, on the conveyor, a misalignment detection pattern for detecting a relative misalignment between the toner images transferred onto the transfer material from the plurality of photosensitive members;

a pattern reading unit configured to read the misalignment detection pattern; and a correction unit configured to correct the relative misalignment between the toner images based on the reading result obtained by the pattern reading unit, wherein the light amount control unit is configured to control a maximum light amount of a first light amount of the light beams for forming the misalignment detection pattern to be higher than a maximum light amount of a second light amount of the light beams for forming an image based on image data input from an external apparatus or a reading apparatus.

18. The apparatus according to claim 17, wherein the image forming unit further comprises a deflection unit configured to deflect the light beams emitted from the exposure unit so as to scan the photosensitive members with the light beams, and not less than one synchronization signal output unit configured to output a synchronization signal by receiving the light beams deflected by the deflection unit, and wherein the light amount control unit controls the exposure unit so as to make the synchronization signal output unit receive the light beams of the first light amount for forming the misalignment detection pattern, in a case where the image forming unit forms the misalignment detection pattern, and controls the exposure unit so as to make the synchronization signal output unit receive the light beams of the second light amount for forming the image based on image data, in a case where the image forming unit forms an image based on the image data.

19. The apparatus according to claim 18, wherein in a case where the first light amount and the second light amount are controlled to be different light amounts, the correction unit adds an offset value, which is correction data for correcting a write position of the image, corresponding to a difference between the first light amount and the second light amount to correction data for correcting a relative misalignment between the toner images based on the reading result obtained by the reading unit, and corrects the relative misalignment between the toner images based on the data to which the offset value is added.

20. The apparatus according to claim 17, wherein the pattern forming unit forms a plurality of density correction patterns with different densities on the conveyor by changing the light amount of the light beams, and controls the image forming unit so as to form the density correction patterns before formation of the misalignment detection pattern, and wherein the light amount control unit sets the first light amount of the light beams for forming the misalignment detection pattern so as to form the misalignment detection pattern with a target density based on the reading result of the density correction pattern read by the pattern reading unit.

* * * * *